US012092387B2

(12) United States Patent
Kim et al.

(10) Patent No.: US 12,092,387 B2
(45) Date of Patent: Sep. 17, 2024

(54) REFRIGERATOR

(71) Applicant: LG Electronics Inc., Seoul (KR)

(72) Inventors: Juyoung Kim, Seoul (KR); Daham Bae, Seoul (KR); Hojin Choi, Seoul (KR); Hyuncheol Lee, Seoul (KR); Jongmoon Jang, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 18/124,158

(22) Filed: Mar. 21, 2023

(65) Prior Publication Data

US 2023/0221058 A1 Jul. 13, 2023

Related U.S. Application Data

(63) Continuation of application No. 17/368,362, filed on Jul. 6, 2021, now Pat. No. 11,624,549.

(30) Foreign Application Priority Data

Jul. 6, 2020 (KR) ..... 10-2020-0082770
Jul. 6, 2020 (KR) ..... 10-2020-0082783

(51) Int. Cl.
*F25D 23/00* (2006.01)
*F25D 23/02* (2006.01)
(Continued)

(52) U.S. Cl.
CPC ..... *F25D 23/028* (2013.01); *F25D 23/04* (2013.01); *F25D 23/063* (2013.01);
(Continued)

(58) Field of Classification Search
CPC ..... F25D 23/02804; F25D 23/063; F25D 23/066; F25D 23/02; F25D 23/082; F25D 2400/18
(Continued)

(56) References Cited

U.S. PATENT DOCUMENTS 3,156,509 A 11/1964 Padgett
4,732,432 A 3/1988 Keil et al.
(Continued)

FOREIGN PATENT DOCUMENTS

CN 105371573 3/2016
DE 2448762 4/1975
(Continued)

OTHER PUBLICATIONS

Extended European Search Report in European Appln. No. 21183759.6, dated Dec. 2, 2021, 8 pages.
(Continued)

*Primary Examiner* — Janet M Wilkens
(74) *Attorney, Agent, or Firm* — Fish & Richardson P.C.

(57) ABSTRACT

A refrigerator includes a cabinet defining a storage space and a door configured to open and close the storage space. The door includes comprises: a panel assembly comprising a front panel, a door frame connected to the panel assembly, a door liner defining, with the door frame, an insulating space that accommodates an insulator, and a basket installed on the door liner. The door liner includes: an outer body, a liner extension portion extending from the outer body in a direction crossing the outer body, and a plurality of ribs that are disposed at the outer body and that are spaced apart from the liner extension portion. The door frame comprises a frame extension portion that is disposed between the plurality of ribs and the liner extension portion.

20 Claims, 22 Drawing Sheets

(51) Int. Cl.
*F25D 23/04* (2006.01)
*F25D 23/06* (2006.01)
*F25D 23/08* (2006.01)

(52) U.S. Cl.
CPC ..... *F25D 23/066* (2013.01); *F25D 23/082* (2013.01); *F25D 2400/18* (2013.01)

(58) Field of Classification Search
USPC ..... 312/405, 405.1; 220/592.1, 902
See application file for complete search history.

(56) References Cited

U.S. PATENT DOCUMENTS

| | | | | |
|---|---|---|---|---|
| 2014/0132143 | A1 | 5/2014 | Kim et al. | |
| 2015/0285551 | A1* | 10/2015 | Aiken | A47F 3/0478 62/155 |
| 2016/0061514 | A1* | 3/2016 | Seo | F21V 33/0044 312/405 |
| 2017/0188721 | A1 | 7/2017 | Park et al. | |
| 2017/0191746 | A1 | 7/2017 | Seo | |
| 2019/0178568 | A1 | 6/2019 | Koo | |
| 2021/0199367 | A1 | 7/2021 | Kim et al. | |
| 2021/0325104 | A1 | 10/2021 | Kang et al. | |
| 2021/0372688 | A1 | 12/2021 | Kang et al. | |
| 2021/0396456 | A1 | 12/2021 | Park et al. | |
| 2022/0003482 | A1 | 1/2022 | Bae et al. | |
| 2022/0003494 | A1 | 1/2022 | Kwon et al. | |
| 2022/0221216 | A1 | 7/2022 | Jin | |

FOREIGN PATENT DOCUMENTS

| | | |
|---|---|---|
| EP | 3896372 | 10/2021 |
| EP | 4027083 | 7/2022 |
| JP | S5544193 | 3/1980 |
| JP | S6319180 | 2/1988 |
| KR | 20170082091 | 7/2017 |
| KR | 20220005231 | 1/2022 |
| WO | WO 2020096258 | 5/2020 |

OTHER PUBLICATIONS

Hyuncheol et al., English translation of KR20220005231, published on Jan. 13, 2022, 46 pages.

* cited by examiner

REFRIGERATOR

CROSS-REFERENCE TO RELATED APPLICATIONS

This application is a continuation of U.S. application Ser. No. 17/368,362, filed on Jul. 6, 2021, which claims priority under 35 U.S.C. § 119 to Korean Patent Application No. 10-2020-0082770, filed in Korea on Jul. 6, 2020, and Korean Patent Application No. 10-2020-0082783, filed in Korea on Jul. 6, 2020, the entire disclosures of which are hereby incorporated by reference.

BACKGROUND

This specification relates to a refrigerator.

In general, refrigerators are home appliances for storing foods at low temperature in an inner storage space covered by a refrigerator door. Here, the inside of the storage space is cooled using cool air that is generated by being heat-exchanged with a refrigerant circulated in a refrigeration cycle to store the foods in an optimal state.

The refrigerator may be independently placed in a kitchen or living room or may be accommodated in a space defined by a furniture cabinet of the kitchen.

The refrigerator tends to increase in size more and more, and multi-functions are provided to the refrigerator as dietary life changes and pursues high quality, and accordingly, refrigerators of various structures in consideration of user convenience are, brought to the market.

A refrigerator is disclosed in Korean Patent Publication No. 10-2017-0082091 (published on Jul. 13, 2017), which is a prior document.

The refrigerator includes a cabinet defining a refrigerating compartment and a refrigerating compartment door opening and closing the refrigerating compartment. A plurality of door baskets may be provided on the refrigerating compartment door.

The refrigerating compartment door includes a main door that opens and closes the refrigerating compartment and a sub door that opens and closes an opening of the main door and includes a panel assembly.

When a lighting unit provided in the door is turned on while the sub door is closed, foods stored in the door basket and the refrigerating compartment may be visible from the outside through the opening of the main door and the panel assembly.

In the case of the prior art document, the door basket may be installed on the main door, and the sub door may rotate with respect to the main door.

When the refrigerator having a refrigerating compartment door having the same structure, like the prior art document is installed in a furniture cabinet, a portion of the refrigerating compartment door protrudes toward the front of the furniture cabinet. When a portion of the refrigerator protrudes to the outside of the furniture cabinet, the portion protruding forward from the refrigerator occupies a space in the kitchen to reduce space utilization, thereby increasing in possibility of colliding with external obstacles and deteriorating aesthetics.

When the refrigerator is accommodated in the furniture cabinet of the kitchen, a thickness of the refrigerating compartment door has to be reduced to prevent the refrigerating compartment door from protruding to the outside of the cabinet while maintaining a size of the storage space inside the cabinet.

However, the simple reduction in thickness of the structure itself of the refrigerating compartment door, like the prior art document is limited, and a structure in which the inside of the refrigerating compartment door is visible while opening and closing the storage compartment by using one door is required.

SUMMARY

Embodiments provide a refrigerator including a panel assembly through which the inside of a storage compartment is visible while a single door rotates to open and close the storage compartment.

Optionally or additionally, embodiments also provide a refrigerator, in which a basket is installed on a door to accommodate foods, and the foods accommodated in the basket is checked through a panel assembly.

Optionally or additionally, embodiments also provide a refrigerator, in which a door liner and a door frame are prevented from being separated from each other by a weight of foods accommodated in a basket.

In one embodiment, a refrigerator includes: a cabinet having a storage space; and a door configured to open and close the storage space.

In one embodiment, a door includes: a door frame; a door liner configured to define an insulating space, in which an insulator is disposed, together with the door frame; and a basket installed on the door liner.

The door liner may include: an outer body; a liner extension portion extending from the outer body in a direction crossing the outer body; and a rib disposed to be spaced apart from the liner extension portion on the outer body.

The door frame may include a frame extension portion disposed between the rib and the liner extension portion.

The door may further include a panel assembly. The panel assembly may be connected to the door frame. The panel assembly may include a front panel. The front panel may be made of a glass material or transparent plastic material.

A plurality of ribs may be disposed to be spaced apart from each other in a horizontal direction on the outer body.

The door liner may include an inner body configured to define an opening and a connection body configured to connect the inner body to the outer body.

The inner body may include a coupling protrusion coupled to the basket.

The panel assembly may further include an insulating panel disposed to be spaced backward from the front panel. The coupling protrusion may be disposed behind the insulating panel.

In a state in which the basket is coupled to the coupling protrusion, the basket may be disposed on an area defined by the inner body.

The door frame may include an upper frame, a lower frame, and a pair of side frames coupled to the upper frame and the lower frame.

The upper frame may include a front wall connected to a rear surface of the front panel and a rear wall spaced apart from the front wall.

The frame extension portion may extend from the rear wall, and the rib may be disposed on a top surface of the outer body.

The rib includes: a first part extending from the outer body; and a second part extending from the first part so as to be inclined in a direction that is away from the liner extension portion.

The frame extension portion may be seated on the outer body between the first part and the liner extension portion by passing through a space between the second part and the liner extension portion.

The front panel may include: a first portion that is capable of transmitting light; and a second portion disposed outside to restrict the transmission of the light.

At least a portion of the basket may face the first portion in the state of being installed on the door liner.

The door liner may include a liner coupling portion, and the door frame may include a frame coupling portion to which the liner coupling portion is coupled.

A coupling member may be coupled to the liner coupling portion and the frame coupling portion.

The lower frame may include the frame coupling portion.

The frame coupling portion may include a coupling hole to which the coupling member is coupled.

The door liner may include a gasket coupling portion having a recessed shape to which a gasket is coupled. The liner coupling portion may protrude from an outer surface of the gasket coupling portion.

The coupling member may be coupled to the liner coupling portion and the frame coupling portion in a state of being accommodated in the gasket coupling portion.

The lower frame may include: a front wall that is in contact with the front panel; and a rear wall which is spaced apart from the front wall and is in contact with the liner extension portion.

Each of the pair of side frames may include: a side surface portion that is in contact with side surfaces of the upper frame and the lower frame; a rear surface portion, which is bent from a rear end of the side surface portion to extend and is in contact with rear surfaces of the upper frame and the lower frame; and a rear extension portion bent from the rear surface portion to extend in a direction crossing the rear surface portion.

The side frame may include: a front surface portion, which extends in a direction crossing the side surface portion and is in contact with a front surface of the upper frame and a front surface of the lower frame; and a front rib extending from the side surface portion at a rear side of the front surface portion.

The lower frame may include a rear wall, in which a frame fixing portion recessed forward is provided to define a space in which the rear extension portion is disposed.

The lower frame may include a first frame hook protruding backward to fix the side frame. The rear surface portion may include a first hook hole that is penetrated so that the first frame hook is inserted at a position corresponding to a position of the first frame hook.

The lower frame may include a first rib protruding upward to be disposed in a space defined by the front surface portion and the front rib. The lower frame may include a second rib protruding upward to be disposed in front of the front surface portion.

The upper frame may include a second frame hook protruding backward to fix the side frame. The rear surface portion may include a second hook hole that is penetrated so that the second frame hook is inserted at a position corresponding to a position of the second frame hook.

The upper frame may include a rib protruding laterally to be disposed in a space defined by the front surface portion and the front rib. The upper frame may include a rib protruding downward from an upper portion of the upper frame so as to be disposed in front of the front surface portion.

In another embodiment, a refrigerator includes: a cabinet having a storage space; and a door configured to open and close the storage space, wherein the door includes: a front panel; a panel assembly including an insulating panel spaced apart from the front panel; a door frame connected to the panel assembly; a door liner that is in contact with the insulating panel to define an insulating space, in which an insulator is disposed, together with the door frame; a basket installed on the door liner, a first fixing mechanism configured so that an upper portion of the door liner is fixed to an upper portion of the door frame; and a second fixing mechanism configured so that a lower portion of the door liner is fixed to a lower portion of the door frame.

The door frame may include an upper frame, a lower frame, and a pair of side frames coupled to the upper frame and the lower frame. The first fixing mechanism may fix the upper fame to the upper portion of the door liner.

The first fixing mechanism may include: a liner extension portion extending from the upper portion of the door liner; a rib disposed to be spaced apart from the liner extension portion; and a frame extension portion disposed between the rib and the liner extension portion.

The second fixing mechanism may include a coupling member configured to couple the lower frame to the door liner.

The door liner may include: a gasket coupling portion having a shape that is recessed so that the gasket is coupled thereto; and a liner coupling portion protruding from an outer surface of the gasket coupling portion. The lower frame may include a frame coupling portion that is aligned with the liner coupling portion. The coupling member may be coupled to the liner coupling portion and the frame coupling portion in a state of being accommodated in the gasket coupling portion.

In further another embodiment, a refrigerator includes: a cabinet having a storage space; and a door configured to open and close the storage space, wherein the door includes: a panel assembly including a front panel; a door frame connected to the panel assembly; a door liner configured to define an insulating space, in which an insulator is disposed, together with the panel assembly and the door frame; and a basket installed on the door liner.

The door liner may include an inner body configured to define an opening and a liner extension portion bent from a bottom surface of the inner body to extend upward to be in contact with a rear surface of the panel assembly.

The panel assembly may further include an insulating panel disposed behind the front panel, and the liner extension portion may extend upward to be in contact with a rear surface of the insulating panel.

The inner body may include a coupling protrusion coupled to the basket.

The coupling protrusion may be provided in plurality, which are spaced apart from each other in a vertical direction, and the basket may be selectively coupled to the plurality of coupling protrusions. An upper end of the liner extension portion may be disposed lower than an upper end of the basket coupled to the lowermost coupling protrusion.

The door frame may include an upper frame, a lower frame, and a pair of side frames coupled to the upper frame and the lower frame.

Each of the pair of side frames may include: a side surface portion that is in contact with side surfaces of the upper frame and the lower frame; a rear surface portion, which is bent from a rear end of the side surface portion to extend and is in contact with rear surfaces of the upper frame and the lower frame; a rear extension portion bent from the rear surface portion to extend in a direction crossing the rear surface portion; a front surface portion, which extends in a direction crossing the side surface portion and is in contact with a front surface of the upper frame and a front surface of the lower frame; and a front rib extending from the side surface portion at a rear side of the front surface portion.

The lower frame may include a rear wall, in which a frame fixing portion recessed forward is provided to define a space in which the rear extension portion is disposed.

The lower frame may include a first frame hook protruding backward to fix the side frame, and the rear surface portion may include a first hook hole that is penetrated so that the first frame hook is inserted at a position corresponding to a position of the first frame hook.

The lower frame may include a first rib protruding upward to be disposed in a space defined by the front surface portion and the front rib.

The lower frame may include a second rib protruding upward to be disposed in front of the front surface portion.

The upper frame may include a third rib protruding downward to be disposed in front of the rear surface portion.

The upper frame may include a second frame hook protruding backward to fix the side frame, and the rear surface portion may include a second hook hole that is penetrated so that the second frame hook is inserted at a position corresponding to a position of the second frame hook.

The upper frame may include a fourth rib protruding laterally to be disposed in a space defined by the front surface portion and the front rib.

The upper frame may include a fifth rib protruding downward from an upper portion of the upper frame so as to be disposed in front of the front surface portion.

The door liner may further include an outer body, a liner extension portion extending from the outer body in a direction crossing the outer body, and a rib disposed to be spaced apart from the liner extension portion on the outer body, and the door frame may include a frame extension portion disposed between the rib and the liner extension portion.

The door liner may include a liner coupling portion, the door frame may include a frame coupling portion to which the liner coupling portion is coupled, and a coupling member may be coupled to the liner coupling portion and the frame coupling portion.

In further another embodiment, a refrigerator includes: a cabinet configured to define a storage space; and a door configured to open and close the storage space, wherein the door includes: a panel assembly including a front panel and an insulating panel spaced apart from the front panel; a door frame connected to the panel assembly and including a lower frame, an upper frame, and a side frame; and a door liner that is in contact with the insulating panel and defines an insulating space, in which an insulator is disposed, together with the door fame.

The refrigerator may include: a basket installed on the door liner; and a first fixing mechanism configured so that the side frame is fixed to the lower frame.

The refrigerator may further include a second fixing mechanism configured so that the upper frame is fixed to the side frame. The refrigerator may further include a third fixing mechanism configured so that the door liner is fixed to the door frame.

The door liner may include an inner body configured to define an opening and a liner extension portion bent from a bottom surface of the inner body to extend upward to be in contact with a rear surface of the insulating panel.

The details of one or more embodiments are set forth in the accompanying drawings and the description below. Other features will be apparent from the description and drawings, and from the claims.

DETAILED DESCRIPTION OF THE EMBODIMENTS

Figure 1:
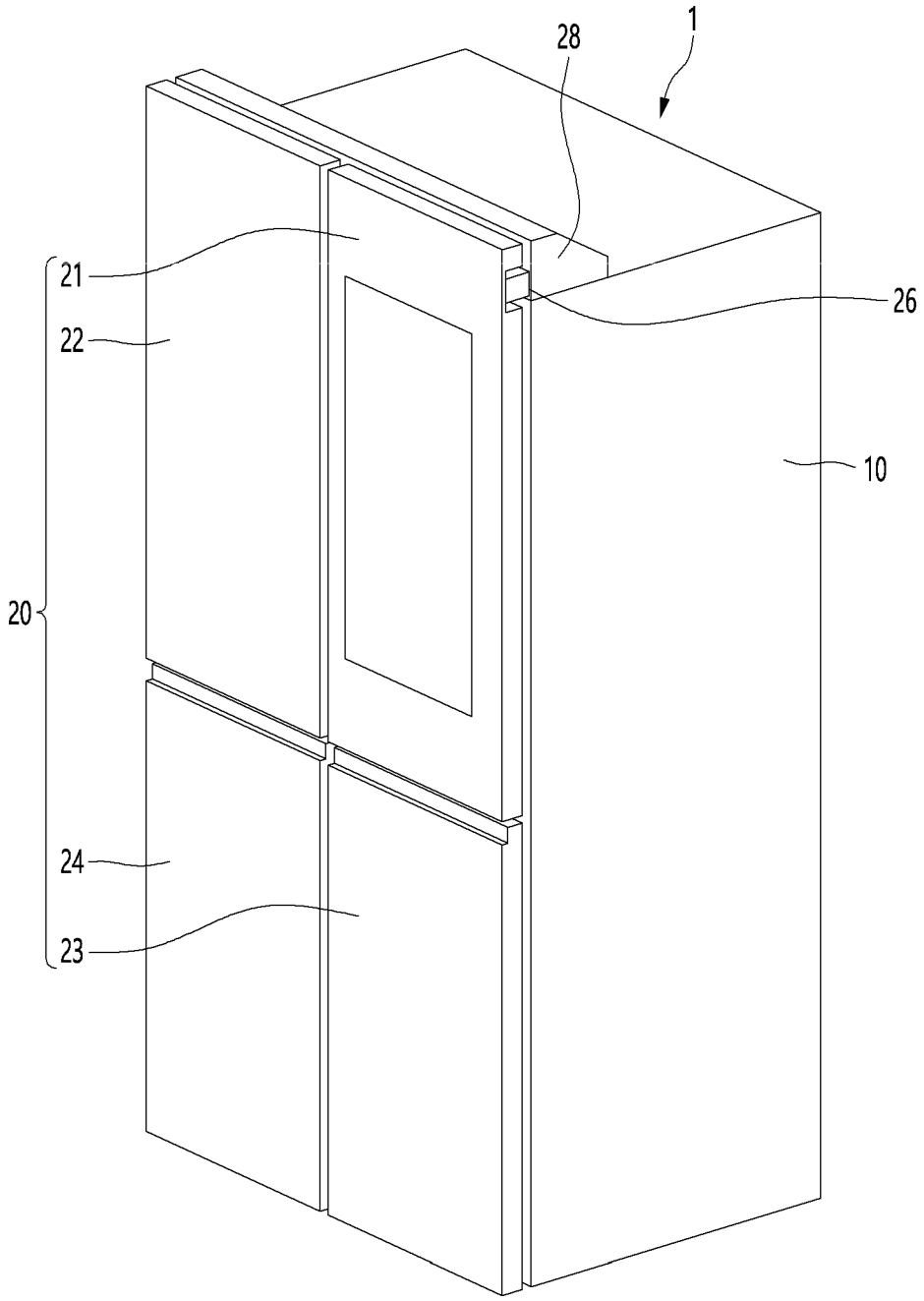
FIG. 1 is a perspective view of a refrigerator according to an embodiment.

FIG. 1 is a perspective view of a refrigerator according to an embodiment.

Referring to FIG. 1, a refrigerator 1 according to this embodiment may include a cabinet 10 defining a storage space and a refrigerator door 20 opening and closing the storage space.

The storage space may include a plurality of storage compartments, and the plurality of storage compartments may be arranged in a vertical direction or a left and right direction.

The number of refrigerator doors 20 may vary according to the number of storage compartments. For example, when the plurality of storage compartments are arranged in the vertical direction, the first storage compartment doors 21 and 22 may open and close the upper first storage compartment, and the second storage compartment doors 23 and 23 may open and close the lower second storage compartment.

In this case, one storage compartment may be opened and closed by one door or a plurality of doors in a rotating or sliding manner.

In FIG. 1, for example, the upper first storage compartment is opened and closed while the first storage compartment doors 21 and 22 arranged in the left and right directions rotate by a hinge 26. The hinge 26 may be at least partially covered by the hinge cover 28. In this embodiment, the hinge cover 28 may be omitted.

The first storage compartment doors 21 and 22 may include a left door and a right door.

Figure 2:
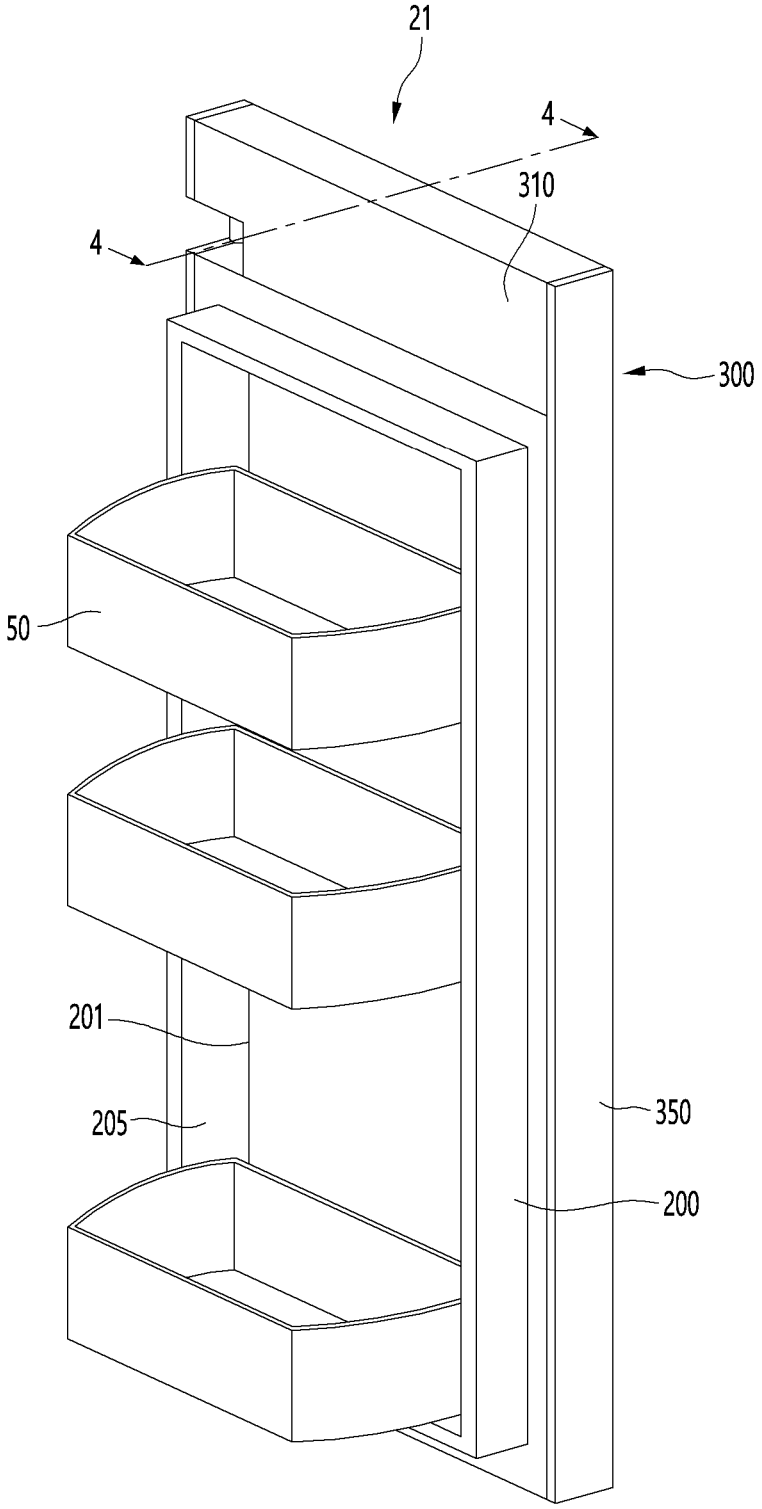
FIG. 2 is a rear perspective view of a first refrigerating compartment door according to an embodiment.
Figure 3:
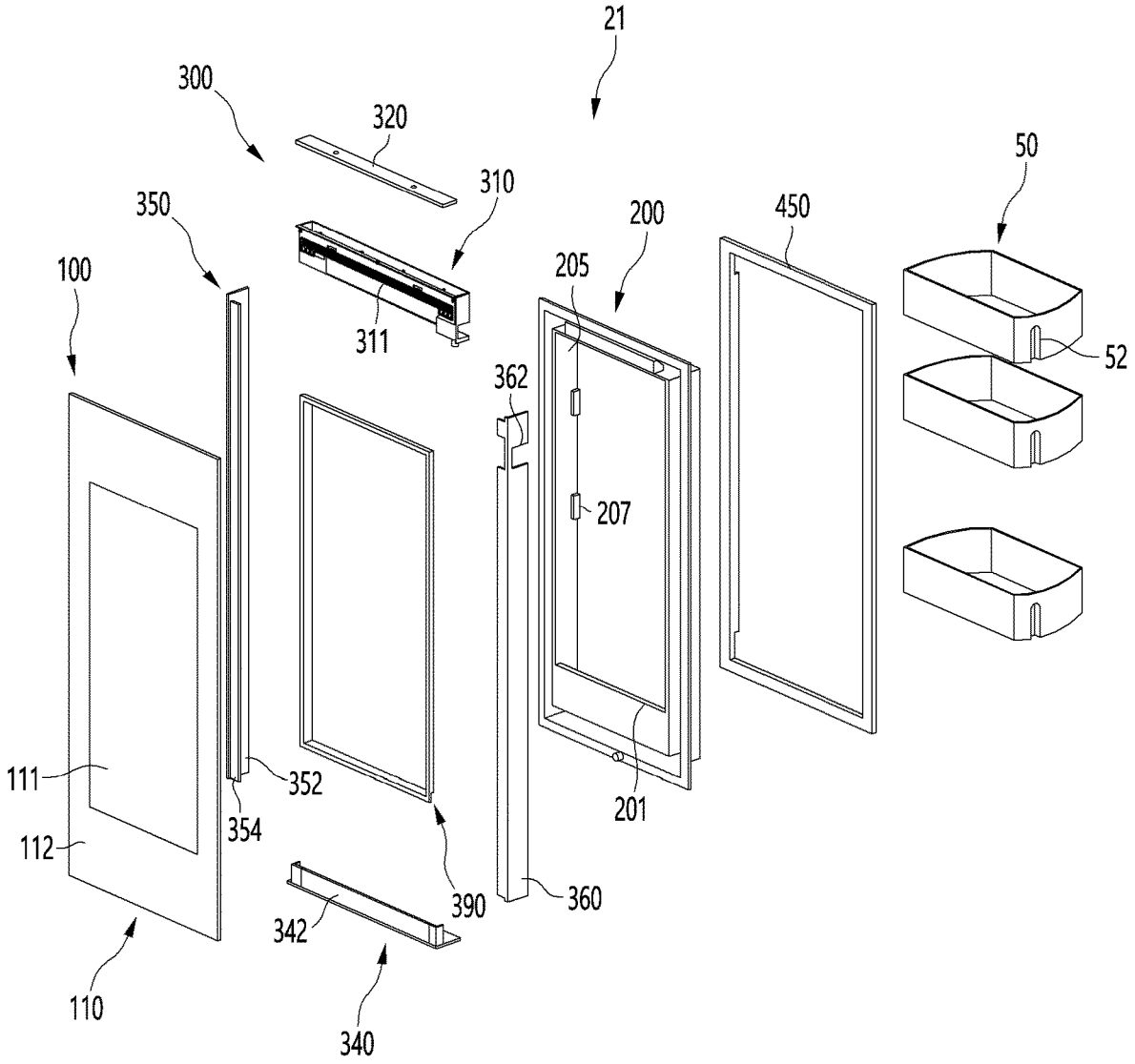
FIG. 3 is an explode perspective view of the first refrigerating compartment door of FIG. 2.
Figure 4:
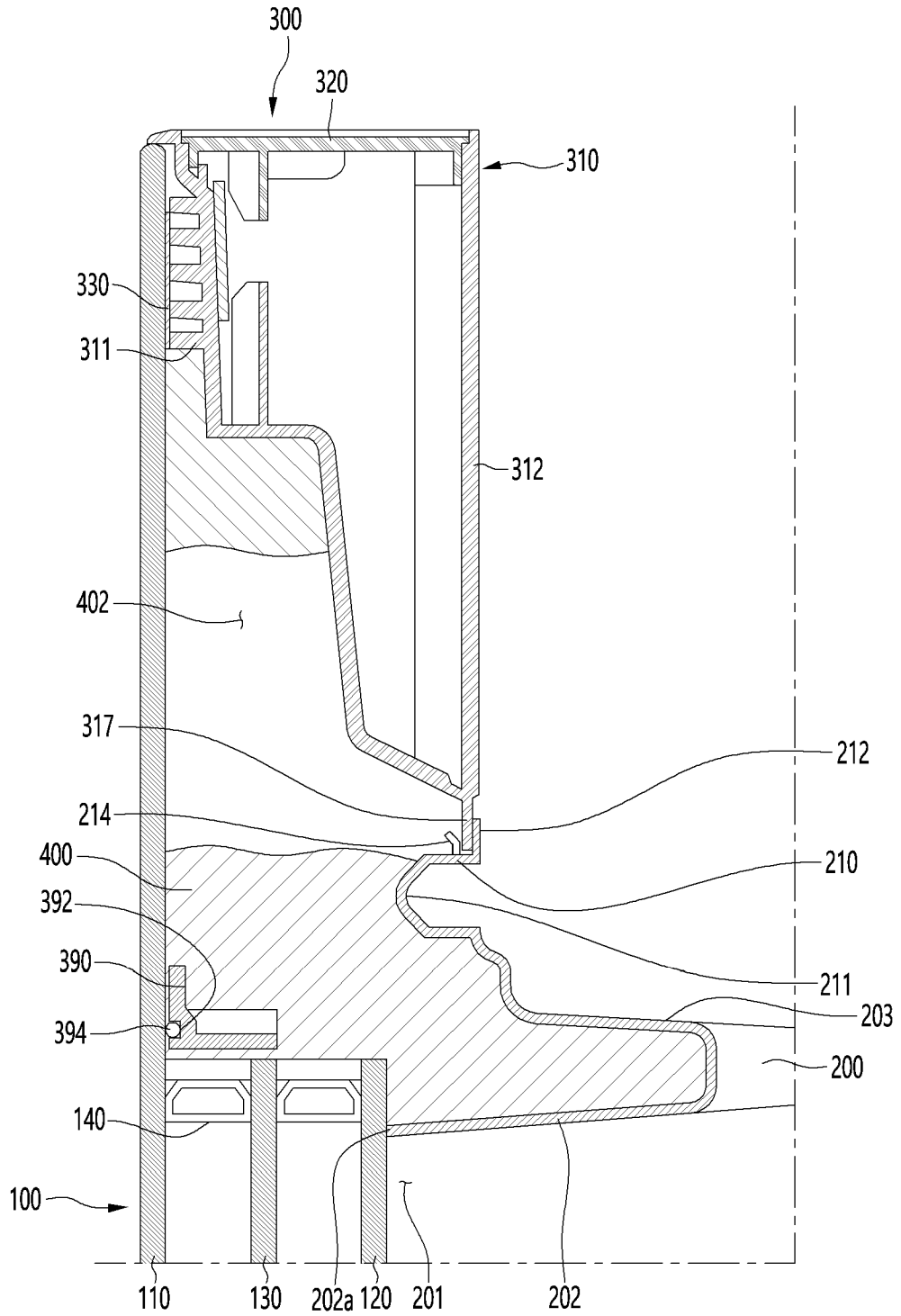
FIG. 4 is a cutaway cross-sectional view taken along line 4-4 of FIG. 2.

FIG. 2 is a rear perspective view of a first refrigerating compartment door according to an embodiment, FIG. 3 is an explode perspective view of the first refrigerating compartment door of FIG. 2, and FIG. 4 is a cutaway cross-sectional view taken along line 4-4 of FIG. 2. In FIG. 2, for example, a rear surface of the first storage compartment door disposed at the right side is illustrated.

Hereinafter, the right first storage compartment door will be described with reference to FIGS. 2 to 4.

The first storage compartment door 21 may be a single door, and when the first storage compartment door 21 rotates, a first storage compartment may be opened.

The first storage compartment door 21 includes some or all of a door frame 300 defining an outer appearance thereof, a panel assembly 100 coupled to the door frame 300, and a door liner 200 defining an insulating space 402, in which the insulator 400 is disposed, together with the door frame 300 and the panel assembly 100.

The door frame 300 may be provided or assembled in the shape of a rectangular frame having an opening, and the panel assembly 100 or the door liner 200 may cover the opening of the door frame 300.

The door liner 200 may include a liner opening 201. The panel assembly 100 may cover liner opening 201.

The panel assembly 100 may include a front panel 110. The front panel 110 may define an outer appearance of a front surface of the first storage compartment door 21.

The front panel 110 may be made of a glass material or a transparent plastic material.

The front panel 110 may include a first portion 111 and a second portion 112 disposed outside the first portion 111. The second portion 112 is disposed to surround the first portion 111.

A printed layer may be disposed along a circumference of an edge of a rear surface of the front panel 110, and the first portion 111 and the second portion 112 may be partitioned from each other by the printed layer. The printed layer may be referred to as a bezel.

The first portion 111 may be a portion through which light irradiated from a lighting unit (not shown) is transmitted, and the printed layer may restrict or block the light transmission through the second portion 112.

The panel assembly 100 may further include one or more insulating panels 120 and 130 disposed behind the front panel 110.

In FIG. 4, for example, two insulating panels are illustrated to be disposed behind the front panel 110, but one insulating panel may be disposed behind the front panel 110.

The insulating panels 120 and 130 may include the first insulating panel 120 and the second insulating panel 130.

The first insulating panel 120 may be disposed behind the front panel 110, and the second insulating panel 130 may be disposed between the front panel 110 and the first insulating panel 120.

A spacer 140 is provided between the front panel 110 and the second insulating panel 130, and an insulating space is provided between the front panel 110 and the second insulating panel 130. An insulating gas may be injected into the insulating space, or the insulating space may be in a vacuum state to define a vacuum insulating space.

A spacer 140 is provided between the second insulating panel 130 and the first insulating panel 120, and an insulating space is provided between the second insulating panel 130 and the first insulating panel 120. An insulating gas may be injected into the insulating space, or the insulating space may be in a vacuum state to define a vacuum insulating space.

Each of the insulating panels 120 and 130 may be made of a glass material or a transparent plastic material.

The spacer 140 may be disposed to face the second portion 112 so that the spacer 140 is not exposed to the outside.

A left and right width and a height of the front panel 110 may be greater than a left and right width and a height of the respective insulating panels 120 and 130.

Thus, the spacer 140 may be disposed at a position that is spaced a predetermined distance inward from an outer end of the front panel 110.

The first storage compartment door 21 may further include a heater frame 390 attached to the rear surface of the front panel 110 by an adhesion portion. The heater frame 390 may be provided in the form of a rectangular frame. The heater frame 390 may be disposed behind the front panel 110, and be disposed between the front panel 110 and the second insulating panel 130 outside the spacer 140 to surround the spacer 140. That is, the spacer 140 may be disposed in a region defined by the heater frame 390.

A groove 392 accommodating a heater 394 may be defined in a front surface of the heater frame 390. The heater 394 may provide heat to the front panel 110 to prevent water droplets from being generated on the front panel 110. The heater frame 390 may be attached to a rear surface of the second portion 112 of the front panel 110 so that the heater frame 390 is not exposed to the outside.

The door frame 300 may be provided by a single frame or by assembling a plurality of frames.

The door frame 300 may be fixed to the rear surface of the front panel 110 by an adhesion portion 330. The adhesion portion 330 may be, for example, an adhesive or a double-sided tape.

The adhesion portion 330 may be disposed on the rear surface of the second portion 112 of the front panel 110 so that the adhesion portion 330 is not exposed to the outside.

In the state in which the door frame 300 is attached to the front panel 110, the door frame 300 may cover a circumferential surface (including a top surface, a bottom surface, and both side surfaces) of the front panel 110.

The door frame 300 may include some or all of an upper frame 310, a lower frame 340, and a pair of side frames 350 and 360 connecting the upper frame 310 to the lower frame 340.

The upper frame 310 may have a space in which various components of an electric wire are disposed, and the space may be covered by the frame cover 320.

Each of the side frames 350 and 360 may include a side surface portion 352 that is in contact with side surfaces of the upper frame 310 and the lower frame 340 and a front surface portion 354, which extends from the side surface portion 352 in a direction crossing the side surface portion 352 and is in contact with a front wall 311 of the upper frame 310 and a front wall 342 of the lower frame 340.

The front surface portion 354 may extend from the side surface portion 352 at a position spaced a predetermined distance backward from a front end of the side surface portion 352.

A front surface of the front surface portion 354 may adhere to a rear surface of the front panel 110 by the adhesion portion.

A rear surface of the front surface portion 354 may be in contact with front surfaces of the upper frame 310 and the lower frame 340 and be coupled to the upper frame 310 and the lower frame 340 by a coupling member such as, for example, a screw.

A slot 362 providing a space in which a hinge 26 is disposed may be provided in any one of the pair of side frames 350 and 360.

The door liner 200 may include an inner body 202 defining the liner opening 201. The inner body 202 includes a top surface, a bottom surface, and both side surfaces 205.

A coupling protrusion 207 coupled to a basket 50 may be provided on the inner body 202. For example, the coupling protrusion 207 may be provided on each of the both side surfaces 205. A plurality of coupling protrusions 207 disposed on both the side surfaces may be disposed to be spaced apart from each other in the vertical direction. A protrusion groove 52 that receives the coupling protrusion 207 may be defined in each of both side walls of the basket 50. Thus, when the basket 50 moves downward in a state in which the basket 50 is disposed in the liner opening 201 of the inner body 202, the coupling protrusion 207 may be accommodated in the protrusion groove 52 so that the basket 50 is supported by the protrusion groove 52. The coupling protrusion 207 may be disposed behind the first insulating panel 120.

In the state in which the basket 50 is coupled to the coupling protrusion 207, the basket 50 may be disposed in a region defined by the inner body 202.

In the state in which the basket 50 is mounted on the door liner 200. and the basket 50 is mounted on the door liner 200, at least a portion of the basket 50 may be disposed to face a first portion 111 of the front panel 110. Thus, when the lighting unit operates, the basket 50 and the foods accommodated in the basket 50 may be visible from the outside by the light passing through the first part 111.

An end 202*a* of the inner body 202 may be in contact with the panel assembly 100. For example, the end 202*a* of the inner body 202 may be in contact with the rear surface of the first insulating panel 120.

Here, the end 202*a* of the inner body 202 may be in contact with a position spaced a predetermined distance inward from the outer end the first insulating panel 120.

The door liner 200 may further include an outer body 210 and a connection body 203 connecting the outer body 210 to the inner body 202.

The door liner 200 may include a gasket coupling portion 211 to which the gasket 450 is coupled. The gasket coupling portion 211 may be provided in a recessed shape, and the outer body 210 and the connection body 203 may provide the gasket coupling portion 211.

The lighting unit may be installed on the door liner 200. For example, the lighting unit may be installed on the inner body 202, and a portion thereof may be disposed to face the opening 201.

The door liner 200 may further include a liner extension portion 212 that is bent around the outer body 210 to extend and is in contact with the door frame 300. The liner extension portion 212 may extend from the outer body 210 in a direction crossing the outer body 210.

The liner extension portion 212 may be in contact with a frame extension portion 317 provided on the rear wall 312 of the upper frame 310 and the rear wall 344 of the lower frame 340.

The liner extension portion 212 and the frame extension portion 317 may adhere to each other by the adhesion portion. In this case, the adhesion portion may be provided on some or all of the contact portions between the liner extension portion 212 and the door frame 300. Alternatively, the liner extension portion 212 and the frame extension portion 317 may be in contact with each other without the adhesion portion. In this embodiment, it will be defined and described that the two members are in contact with each other even when the two members are coupled to each other in a state in which the adhesion portion is disposed between the two members.

Also, the liner extension portion 212 may be in contact with a rear side of each of the side frames 350 and 360.

As described above, the insulating space 402, in which the insulator 400 is disposed may be defined by the door frame 300, the panel assembly 100, and the door liner 200.

An opening (not shown) for injecting a foaming liquid may be defined in the door frame 300 or the door liner 200. As the foaming liquid is injected through the opening, and the foaming liquid is cured, the insulator 400 may be disposed in the insulating space 402.

In the process of curing the foaming liquid, the foaming liquid is combined with a structure that is in contact with the foaming liquid. That is, the foaming liquid not only serves for insulation, but also serves as a connection portion that connects two spaced structures to each other.

For example, in FIG. 4, a portion of the insulator 400 may be disposed to surround the insulating panels 120 and 130 in the panel assembly 100, and in particular may be in contact with a rear surface of the first insulating panel 120. A portion of the insulator 400 that is in contact with the rear surface of the first insulating panel 120 is in contact with the inner body 202 of the door liner 200. Thus, the insulator 400 serves to connect the door liner 200 to the panel assembly 100.

Also, the other portion of the insulator 400 is in contact with the frame extension portion 317 the upper frame 310 and the outer body 210 of the door liner 200. Thus, the insulator 400 connects the door liner 200 to the upper frame 310.

In this embodiment, since the basket 50 is coupled to the door liner 200, the basket 50 and a load of foods accommodated in the basket 50 act on the door liner 200.

Force acting on the door liner 200 acts as a contact portion between the door liner 200 and the upper frame 310. The force applied to the contact portion between the door liner 200 and the upper frame 310 acts as force to separate the door liner 200 from the door frame 300.

Even if the door liner 200 adheres to the upper frame 310 by the adhesion portion, and the door liner 200 and the upper frame 310 are indirectly connected to each other by the insulator 400, if the load acting on the door liner 200 is large, there is a possibility that the contact portions 212 between the frame extension portion 317 of the upper frame 310 and the door liner 200 are separated from each other.

Thus, the first storage compartment door 21 according to this embodiment may further include a fixing mechanism that prevents the door liner 200 and the door frame 300 from being separated from each other even if the basket 50 is installed on the door liner 200, and loads of the basket 50 and foods are applied to the door liner 200.

The fixing mechanism includes, for example, a first fixing mechanism that fixes the door liner 200 and the upper frame 310 and a second fixing mechanism that prevents the door liner 200 and the lower frame 340 from being fixed.

Figure 5:
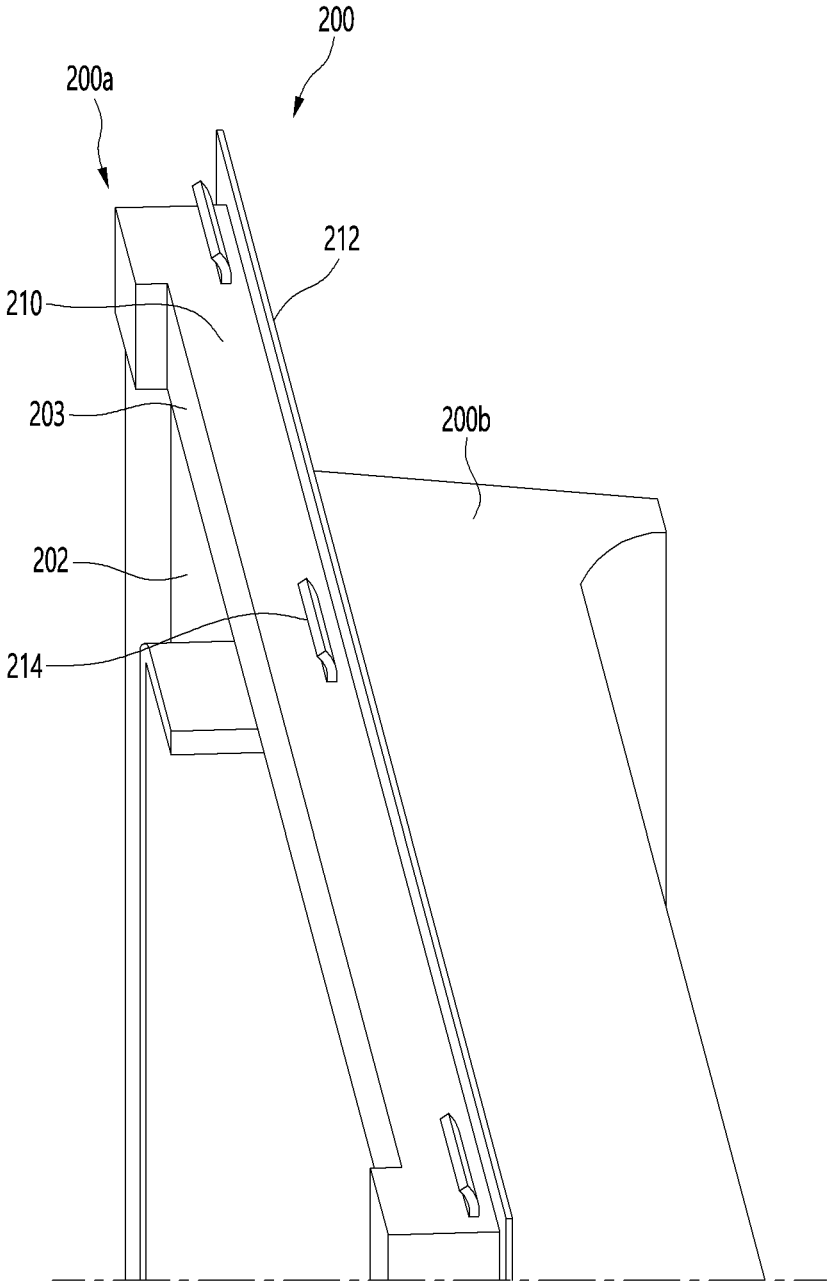
FIG. 5 is a top perspective view of a door liner according to an embodiment.
Figure 6:
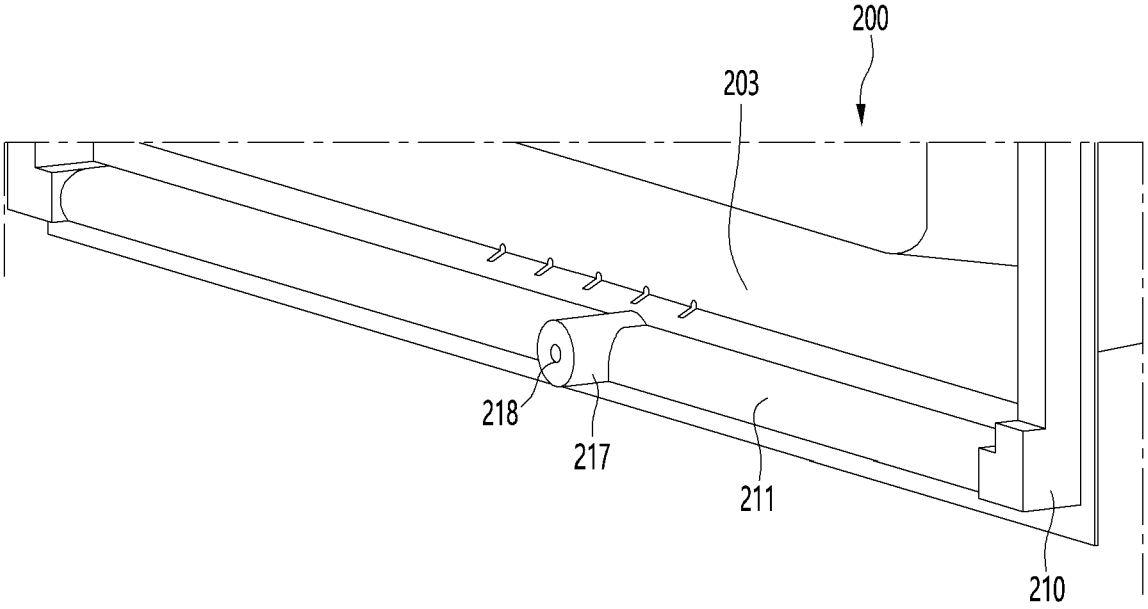
FIG. 6 is a view illustrating a lower structure of the door liner according to an embodiment.
Figure 7:
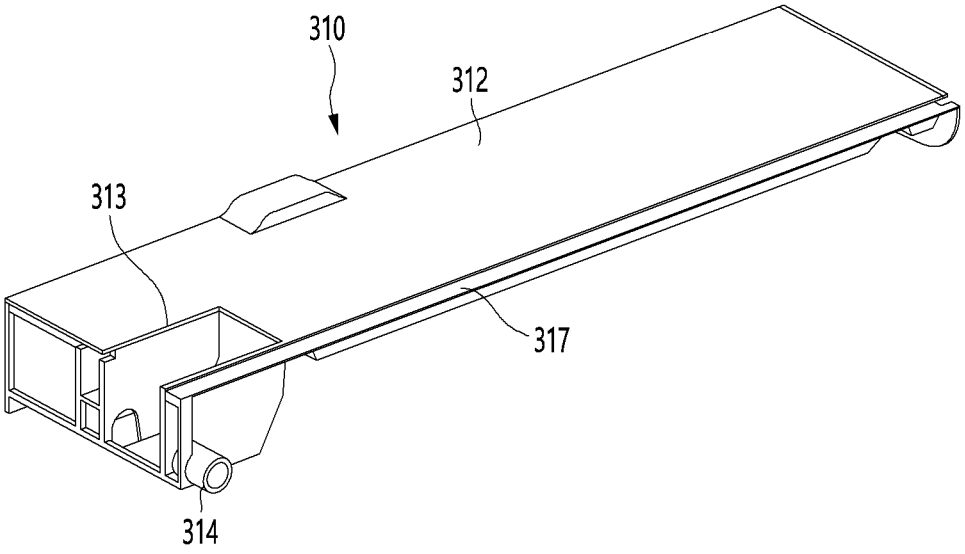
FIG. 7 is a bottom perspective view of an upper frame according to an embodiment.
Figure 8:
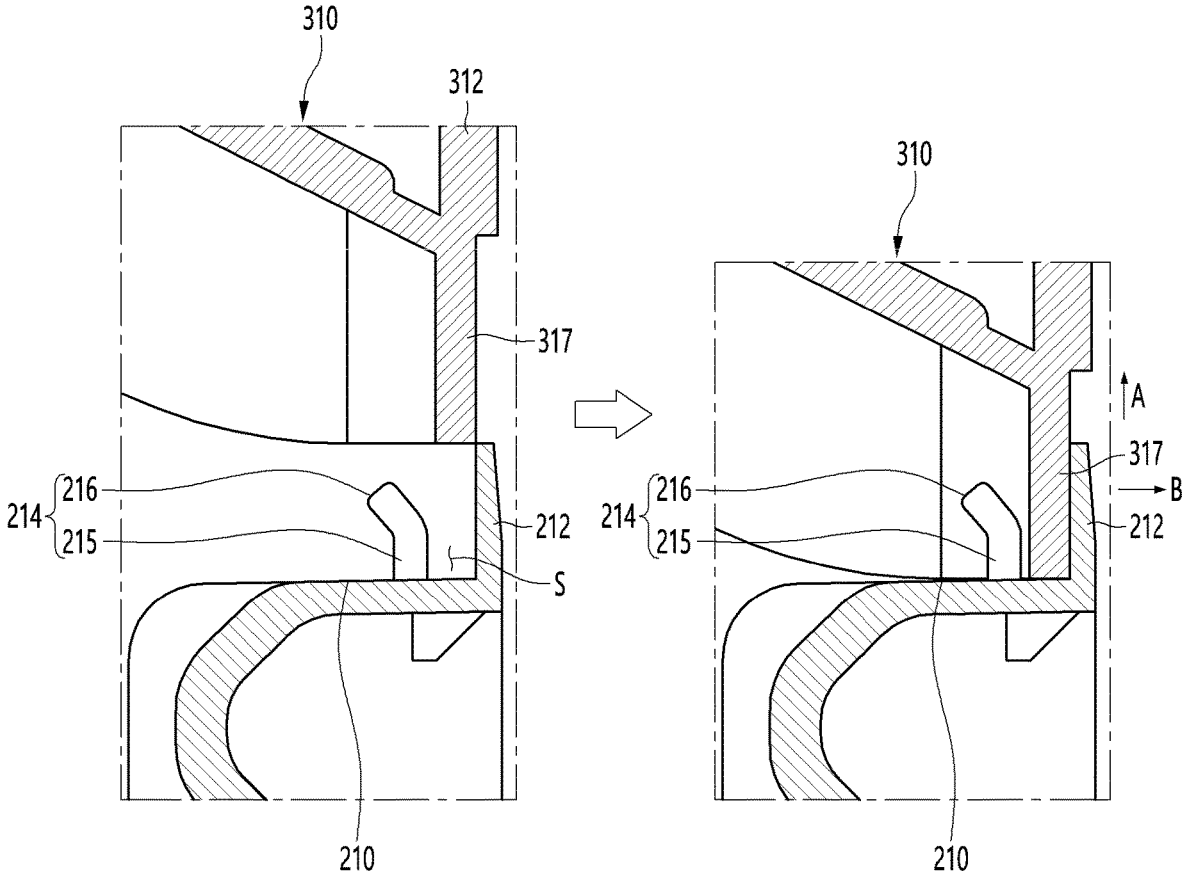
FIG. 8 is a view illustrating a state in which an upper portion of the door liner is coupled to an upper frame.

FIG. 5 is a top perspective view of the door liner according to an embodiment, and FIG. 6 is a view illustrating a lower structure of the door liner according to an embodiment. FIG. 7 is a bottom perspective view of the upper frame according to an embodiment. FIG. 8 is a view illustrating a state in which an upper portion of the door liner is coupled to an upper frame.

Referring to FIGS. 4 to 8, the door liner 200 may include a first liner 200*a* that is a portion connected to the door frame 300 and a second liner that extends from the first liner 200*a* and is accommodated in the first storage compartment.

The first liner 200*a* may define a portion of the inner body 202 and portions of the outer body 212 and the connection body 203.

The second liner 200*b* may define the other portion of the inner body 202 and the other portion of the connection body 203.

The first liner 200*a* may include the gasket coupling portion 211 and the liner extension portion 212.

The first fixing mechanism may include a rib 214 extending upward from a top surface of the outer body 210. The rib 214 is disposed to be spaced apart from the liner extension portion 212.

For example, the rib 214 may be disposed in front of the liner extension portion 212, and a space S, in which the frame extension portion 317 is disposed may be defined in a gap between the rib 214 and the liner extension portion 212.

A plurality of ribs 214 may be disposed to be horizontally spaced apart from each other on the top surface of the outer body 210 to increase in fixing force between the upper frame 310 and the door liner 200.

To facilitate the coupling between the door liner 200 and the upper frame 310, each of the ribs 214 may include a first part 215 extending approximately vertically from the outer body 210 and a second part extending from the first pat 215 so as to be inclined in a direction away from the liner extension portion 212. Thus, the gap between the second part 216 and the liner extension portion 212 increases upward.

The frame extension portion 317 passes between the second part 216 and the liner extension portion 212 and then is seated on the outer body 210 between the first part 215 and the liner extension portion 212.

The upper frame 310 may include a rear wall 312, and the frame extension portion 317 may be provided on a lower end of the rear wall 312. The frame extension portion 317 may extend by a length of a left and right width of the upper frame 310.

A hinge accommodation portion 313 having a shape that is recessed so that the hinge 26 is disposed may be defined in the rear wall 312 of the upper frame 310, and a guide 314 through which a shaft (not shown) provided on the hinge 26 passes may be provided on a bottom of the upper frame 310.

Referring to FIG. 8, an upper portion of the door liner 200 is disposed below the upper frame 310 to couple the upper portion of the door liner 200 to the upper frame 310, and the frame extension portion 317 and the space S are aligned with each other.

Then, when the door liner 200 moves upward (in a direction of an arrow A), the frame extension portion 317 is inserted into the insertion space S between the rib 214 and the liner extension portion 212.

The frame extension portion 317 may be seated on the top surface of the outer body 210 in a state of being inserted into the space S and may be in contact with the liner extension portion 212.

When the basket 50 is mounted on the door liner 200, and the foods are accommodated in the basket 50, the liner extension portion 212 of the door liner 200 may move in a direction (for example, a direction of an arrow B in FIG. 8) away from the frame extension portion 317 by the load applied to the door liner 200.

However, in this embodiment, since the rib 214 is present in front of the frame extension portion 317, even if force is applied to the door liner 200 in the direction B, the rib 214 may be hooked with the frame extension portion 317 to prevent the door liner 200 from being separated from the upper frame 310.

The rib 214 may be maintained in a state in contact with the frame extension portion 317. Alternatively, the rib 214 may be spaced a minute interval from the frame extension portion 317.

The second fixing mechanism may include a liner coupling portion 217 protruding from the first liner 200*a* of the door liner 200 and a coupling member (see reference numeral 240 in FIG. 10) coupled to pass through the liner coupling portion 217.

The liner coupling portion 217 may protrude from the connection body 203. Here, the liner coupling portion 217 may protrude from the connection body 203 at a position corresponding to the gasket coupling portion 211. A coupling hole 218 through which the coupling member 240 passes may be defined in the liner coupling portion 217.

Other portions constituting the second fixing mechanism will be described later with reference to the drawings.

Figure 9:
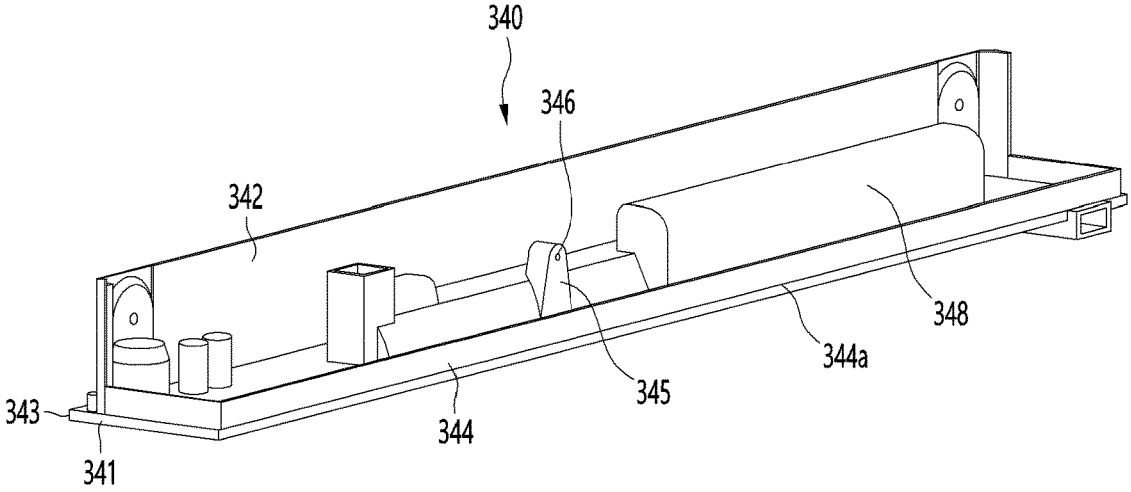
FIG. 9 is a perspective view of a lower frame according to an embodiment.
Figure 10:
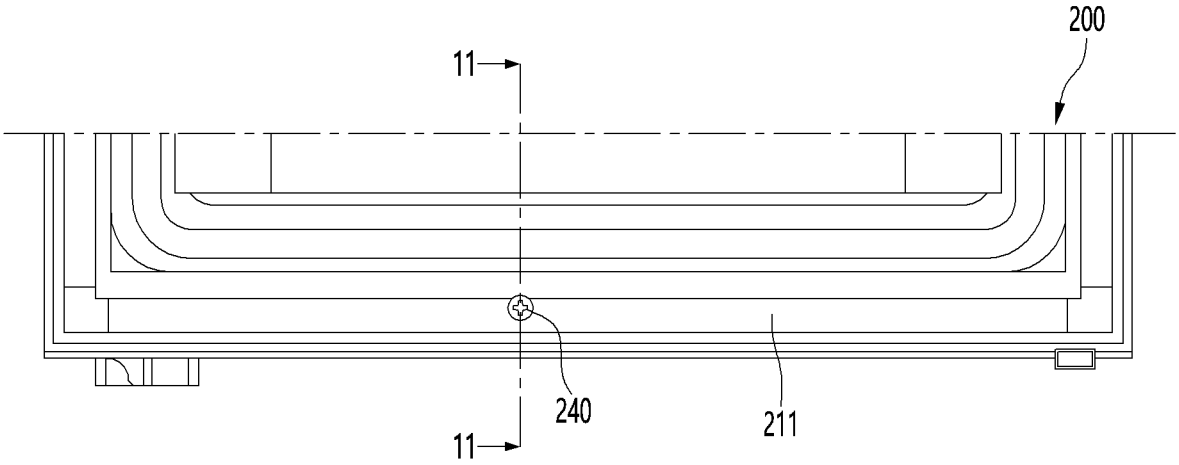
FIG. 10 is a view illustrating a state in which a coupling member is coupled to the door liner so that the lower frame and the door liner are coupled to each other.
Figure 11:
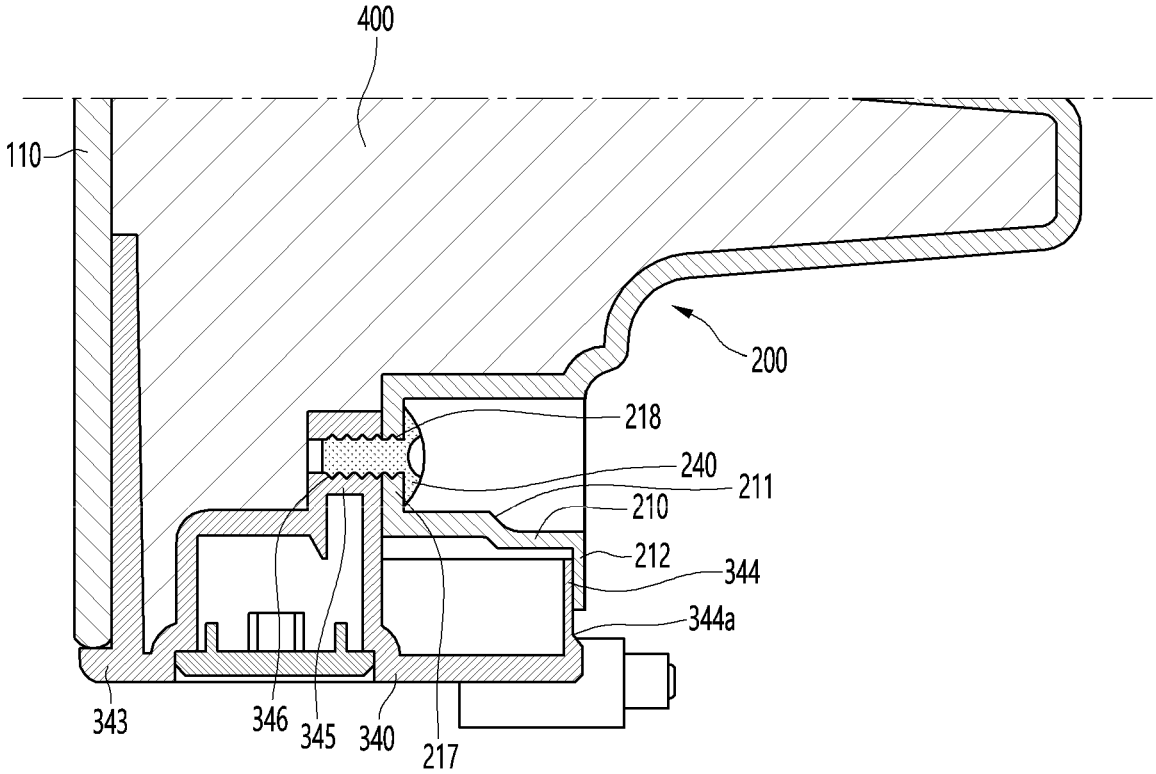
FIG. 11 is a cross-sectional view taken along line 11-11 of FIG. 10.

FIG. 9 is a perspective view of the lower frame according to an embodiment, FIG. 10 is a view illustrating a state in which the coupling member is coupled to the door liner so that the lower frame and the door liner are coupled to each other, and FIG. 11 is a cross-sectional view taken along line 11-11 of FIG. 10.

Referring to FIGS. 9 to 11, the lower frame 340 may include some or all of a base 341, a front wall 342 extending upward at a position spaced a predetermined distance from a front end of the base 341, and a rear surface 344 extending from the base 34 at a rear side of the front wall 341.

The front portion of the base 341 serves as a support portion 343 supporting the lower side of the front panel 110.

A recessed seating portion 344*a* having a recessed shape so that a portion of the liner extension portion 212 of the door liner 200 is disposed may be provided in the rear wall 344. The liner extension portion 212 is in contact with a rear surface of the rear wall 344 in the seating portion 344*a*.

The liner extension portion 212 may adhere to the rear wall 344 by the adhesion portion, or the liner extension portion 212 may be in direct contact with the rear wall 344 without the adhesion portion.

The lower frame 340 may further include a handle portion 348 that provides a space for user's grip.

The second fixing mechanism may further include a frame coupling portion 345 provided on the lower frame 340 so that the door liner 300 and the lower frame 340 are coupled to each other by the coupling member 240.

The frame coupling portion 345 may be disposed between the front wall 341 and the rear wall 344. The frame coupling portion 345 may be spaced apart from the front wall 341. Thus, a portion of the insulator 400 may be disposed between the front wall 341 and the frame coupling portion 345.

The frame coupling portion 345 may be provided in a shape protruding upward from the base 341. The frame coupling portion 345 may include a coupling hole 346 through which the coupling member 240 passes.

To couple the lower portion of the door liner 200 to the lower frame 340, the liner coupling portion 217 of the door liner 200 is in contact with the frame coupling portion 345 of the lower frame 310.

Then, the coupling hole 218 of the liner coupling portion 217 and the coupling hole 346 of the frame coupling portion 345 are aligned with each other. Also, the liner extension portion 212 of the door liner 200 is in contact with the rear surface of the rear wall 344 of the lower frame 340.

In this state, the coupling member 240 is coupled to the liner coupling portion 217 and the frame coupling portion 345 in a state of being accommodated in the gasket coupling portion 211.

Then, the door liner 200 may be fixed to the lower frame 340, and even if the load is applied to the door liner 200, the door liner 200 may be prevented from being separated from the lower frame 340.

Also, since the coupling member 240 couples the liner coupling portion 217 and the frame coupling portion 345 in the gasket coupling portion 211, the gasket 450 may be coupled to the gasket coupling portion 211, and then, the coupling member 240 may be prevented from being exposed to the outside.

In the above embodiment, the first fixing mechanism has been described as including the rib of the upper frame, but otherwise, the first fixing mechanism may be configured in the same shape as the second fixing mechanism. Alternatively, it is also possible to apply a structure of the first fixing mechanism to the position of the second fixing mechanism as it is. Alternatively, it is also possible to use the first fixing mechanism and the second fixing mechanism, which have the same shape.

Figure 12:
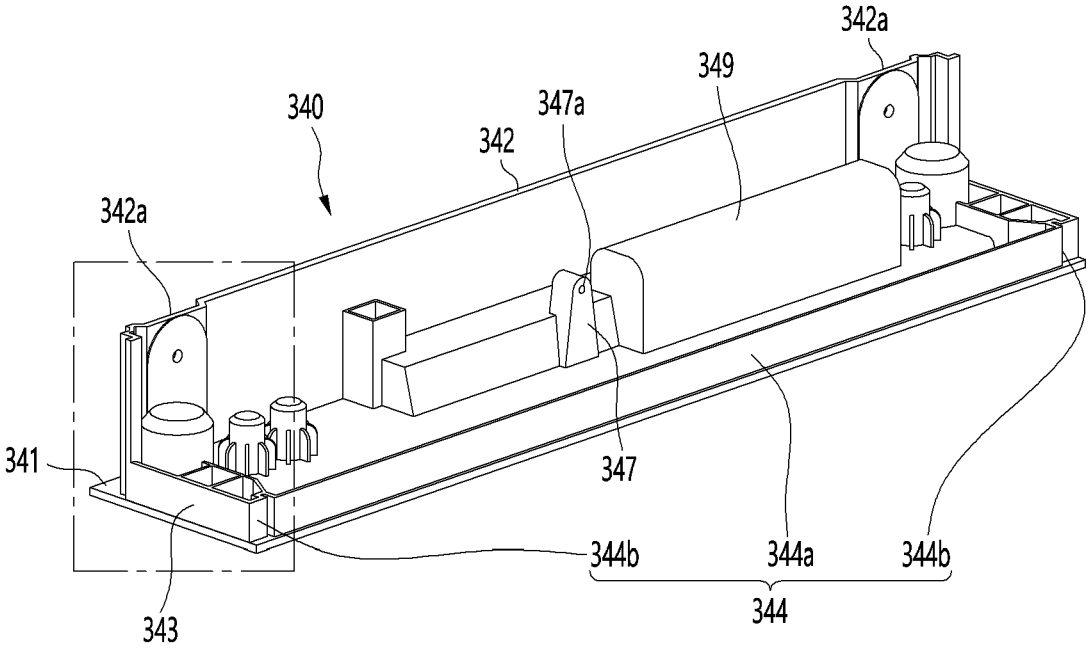
FIG. 12 is a perspective view of a lower frame according to another embodiment.
Figure 13:
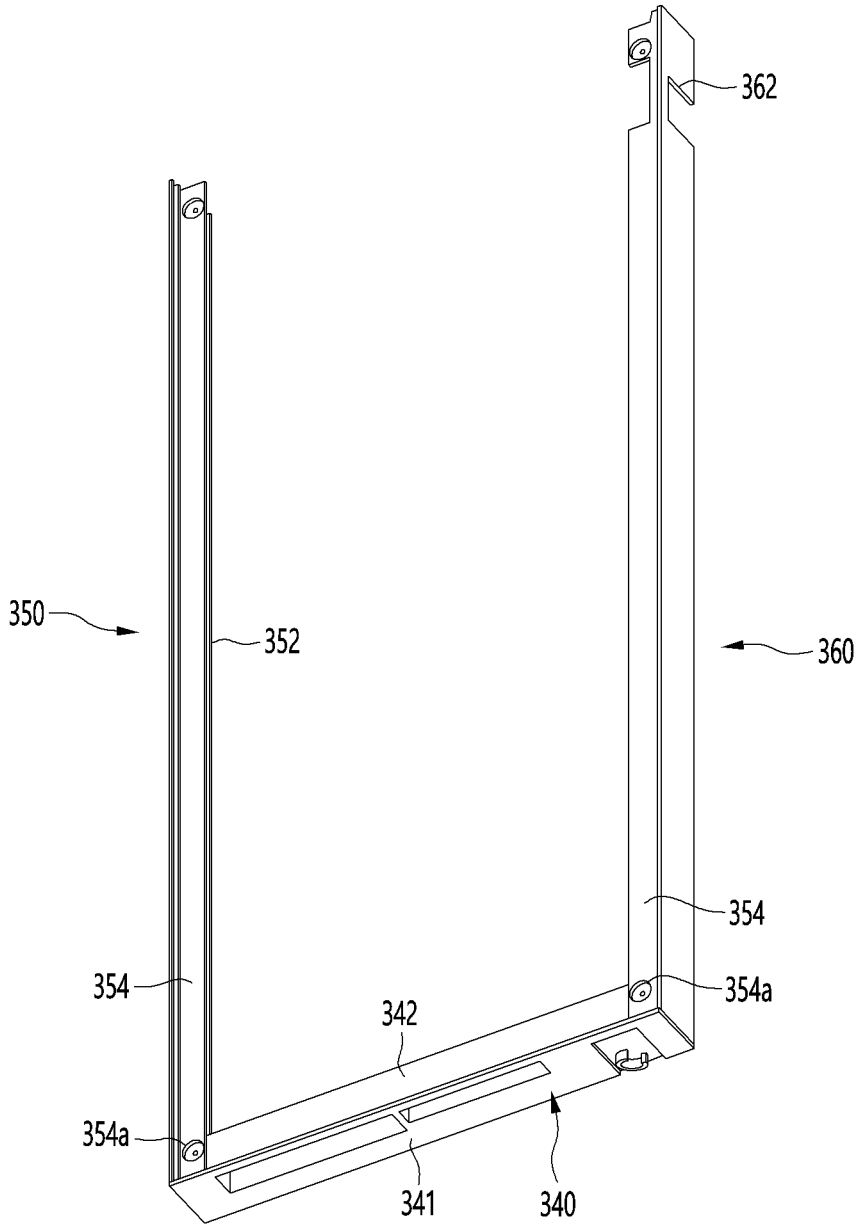
FIG. 13 is a perspective view illustrating a state in which a side frame is coupled to the lower frame according to an embodiment.
Figure 14:
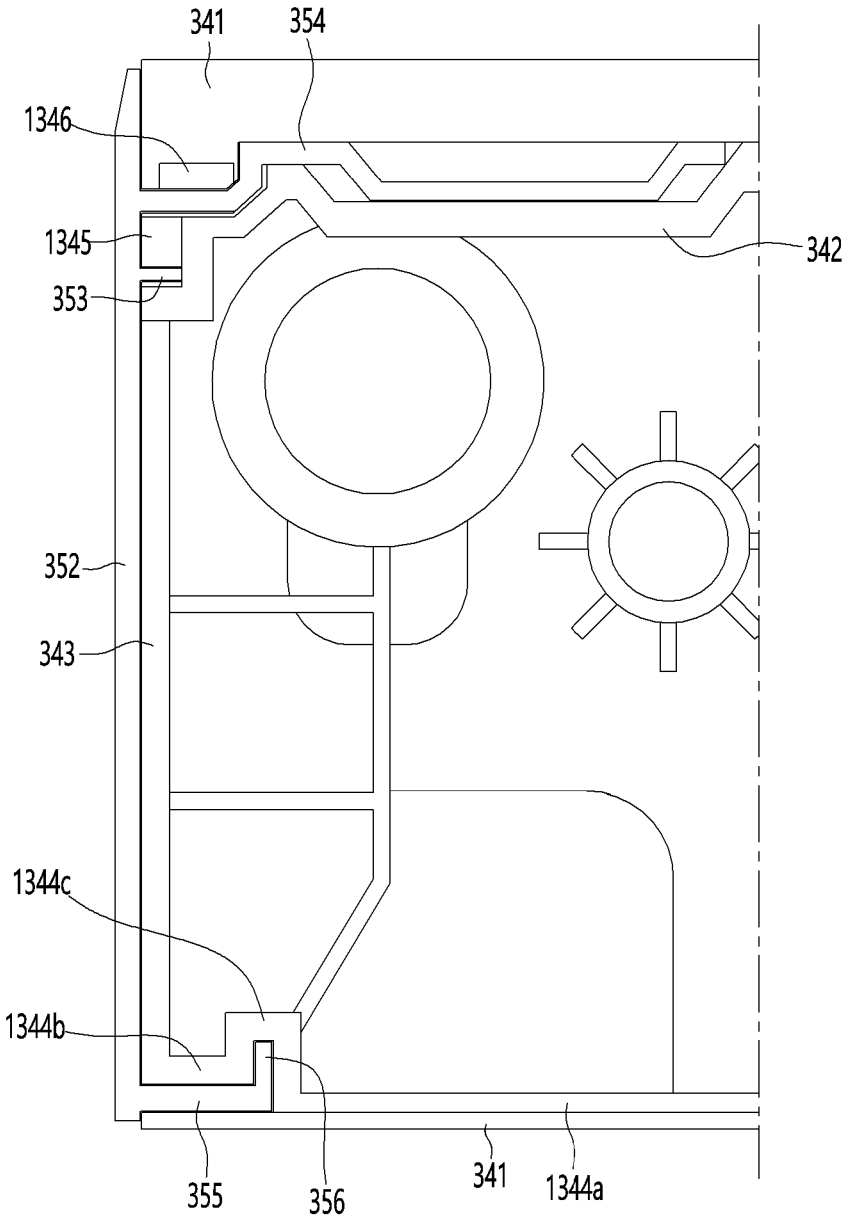
FIG. 14 is a top view illustrating the state in which the side frame is coupled to the lower frame according to an embodiment.
Figure 15:
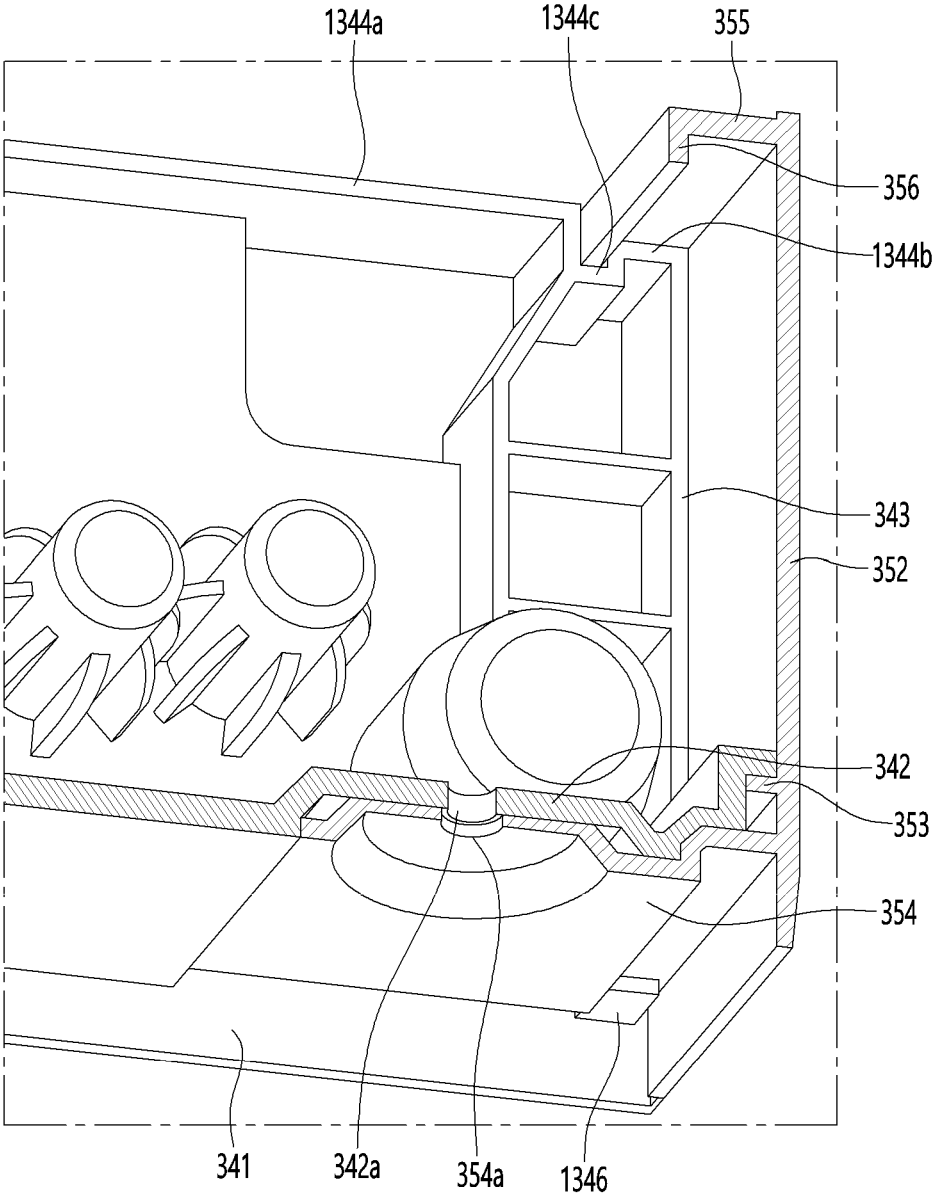
FIG. 15 is a view when viewed in a direction different from that of FIG. 14.
Figure 16:
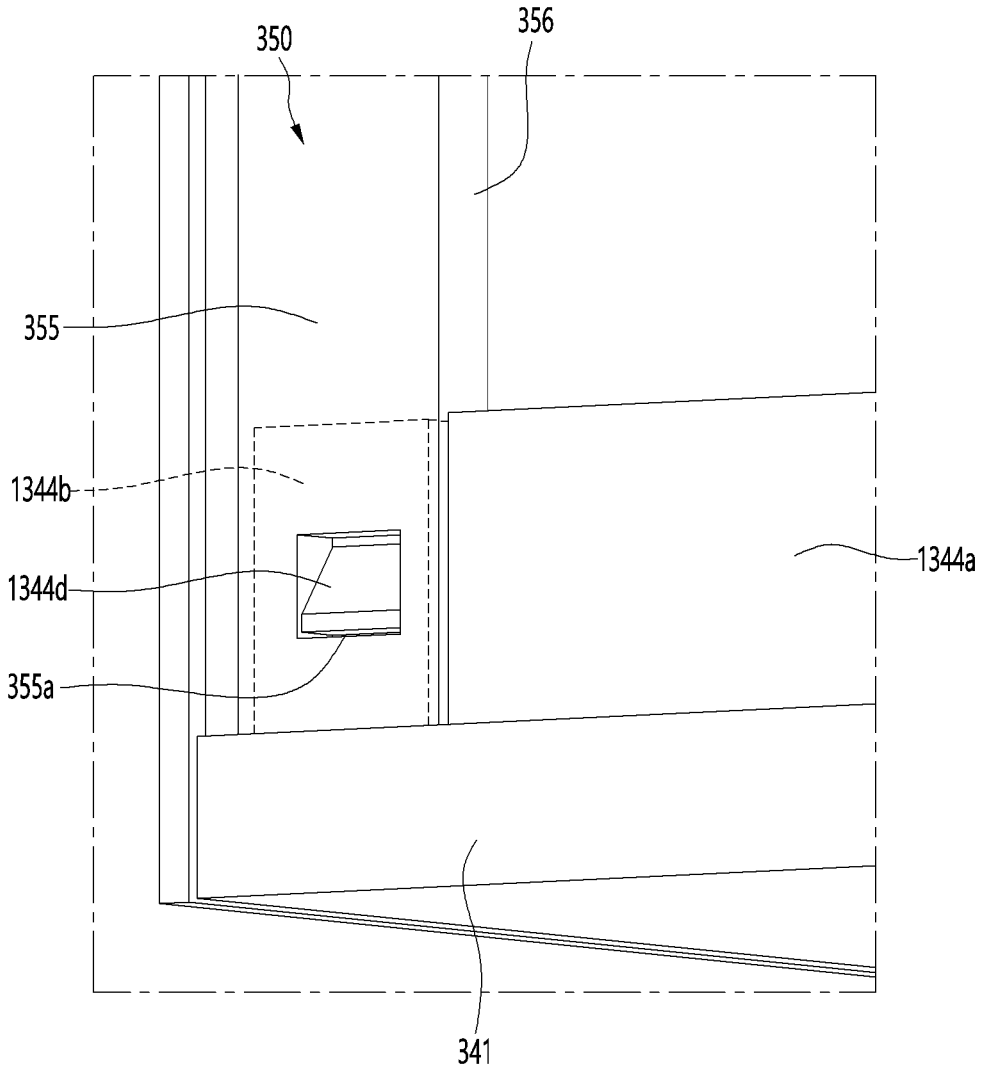
FIG. 16 is a view when viewed in a direction different from that of FIG. 15.

FIG. 12 is a perspective view of a lower frame according to another embodiment, FIG. 13 is a perspective view illustrating a state in which a side frame is coupled to the lower frame according to an embodiment, FIG. 14 is a top view illustrating the state in which the side frame is coupled to the lower frame according to an embodiment, FIG. 15 is a view when viewed in a direction different from that of FIG. 14, and FIG. 16 is a view when viewed in a direction different from that of FIG. 15.

In description of this embodiment, if the same reference numerals are used for the same components as those of the foregoing embodiment, the same description for the same components as those of the foregoing embodiment may be equally applied to this embodiment.

Referring to FIGS. 12 to 15, side frames 350 and 360 may be coupled to a lower frame 340 according to this embodiment. In one embodiment, the side frames 350 and 360 may be coupled to the lower frame 340 while moving downward from an upper side.

The lower frame 340 may include a base 341, a front wall 342 extending upward at a position spaced a predetermined distance from a front end of the base 341, a rear wall 344 extending from the base 341 at a rear side of the front wall 341, and a side wall 343 bent from both ends of the rear wall 344 to extend toward the front wall 341. A front portion of the base 341 may serve as a support portion that supports a lower side of the front panel 110.

Each of the side frames 350 and 360 may include a side surface portion 352 that is in contact with side surfaces of the upper frame 310 and the lower frame 340, a rear surface portion 355, which is bent from a rear end of the side surface portion 352 to extend and is in contact with rear surfaces of the upper frame 410 and the lower frame 340, and a front surface portion 354, which extends from the side surface portion 352 in a direction crossing the side surface portion 352 and is in contact with a front wall 311 of the upper frame 310 and a front wall 342 of the lower frame 340.

Each of the side frames 350 and 360 may further include a front rib 353 extending from the side surface portion 352 at a rear side of the front surface portion 354. The front rib 353 may extend from the side surface portion 352 at a position spaced a predetermined distance backward from the front surface portion 354. The front rib 353 may extend in a direction crossing the side surface portion 352 and may extend in a direction parallel to the front surface portion 354. Thus, an insertion space may be defined between the front surface portion 354 and the front rib 353.

The rear wall 344 may include a liner contact surface 1344*a* that is in contact with a portion of the door liner 200 and frame contact surfaces 1344*b* disposed at both sides of the liner contact surface 1344*a* so as to be in contact with portions of the side frames 350 and 360.

The liner contact surface 1344*a* may be disposed on a rear surface of the rear wall 344. The door liner 200 may adhere to the liner contact surface 1344*a* by an adhesion portion or may be in direct contact with the liner contact surface 1344*a* without the adhesion portion.

The frame contact surface 1344*b* may be disposed on both the sides of the liner contact surface 1344*a* and may be disposed in front of the liner contact surface 1344*a*. The side frames 350 and 360 may be in contact with the frame contact surface 1344*b*. In detail, the rear surface portion 355 may be in contact with the frame contact surface 1344*b*.

In an embodiment, the frame contact surface 1344*b* may be disposed at a position that is spaced a predetermined distance forward from the liner contact surface 1344*a*. For example, the frame contact surface 1344*b* may be disposed to be spaced forward from the liner contact surface 1344*a* by a thickness of the rear surface portion 355. Thus, in a state in which the side frames 350 and 360 are seated on the frame contact surface 1344*b*, the door liner 200 may be disposed on the rear surface portion 355 and the liner contact surface 1344*a*.

The frame contact surface 1344*b* may include a first frame hook 1344*d* to which the side frames 350 and 360 are fixed. The first frame hook 1344*d* may protrude backward from the frame contact surface 1344*b*. A first hook hole 355*a* that is opened at a position corresponding to the position of the first frame hook 1344*d* may be defined in each of the side frames 350 and 360. In detail, the opened first hook hole 355*a* may be defined at a position corresponding to the position of the first frame hook 1344*d* of the rear surface portion 355. Thus, the first frame hook 1344*d* may be inserted into the first hook hole 355*a* so that the side frames 350 and 360 are fixed to the lower frame 340.

In an embodiment, the first frame hook 1344*d* may be inclined to protrude outward as it goes downward. Thus, the side frames 350 and 360 may be easily slidably coupled to the lower frame 340 downward from an upper side.

The rear wall 344 may further include a recessed frame fixing portion 1344*c* that defines a space in which the rear extension portion 356 is disposed between the liner contact surface 1344*a* and the frame contact surface 1344*b*. The frame fixing portion 1344*c* may be recessed toward the front wall 341. Thus, when the side frames 350 and 360 are coupled to the lower frame 340, the side surface portion 352 may be disposed on the side wall 343, the rear surface portion 355 may be disposed on the frame contact surface 1344*b*, and the rear extension portion 356 may be inserted into the frame fixing portion 1344*c* so that the side frames 350 and 360 are fixed.

The side frames 350 and 360 may be in contact with the front wall 342. In detail, when the side frames 350 and 360 are coupled to the lower frame 340, the front surface portion 354 may be in contact with the front wall 342.

In an embodiment, the front wall 342 may include a coupling portion 342*a*, and the front surface portion 354 may include a coupling portion 354*a* corresponding to the position of the coupling hole 342*a*. In this case, the coupling portion 342*a* and the coupling portion 354*a* may be coupled to each other by the coupling member by defining a hole through which the coupling member passes.

The lower frame 340 may further include a first rib 1345 and a second rib 1346 to fix the side frames 350 and 360.

The first rib 1345 may be disposed on a side of the front wall 342. For example, as illustrated in the drawings, the front wall 342 may extend in a longitudinal direction of the lower frame 340, but a side end thereof may be bent several times to provide the first rib 1345 at a side thereof.

The first rib 1345 may protrude upward from the base 341. The front surface portion 354 and the front rib 353 may be spaced a predetermined distance from each other to define the insertion space. The first rib 1345 may be disposed at a position corresponding to the insertion space. Thus, when the side frames 350 and 360 are coupled to the lower frame 340, the first rib 1345 may be disposed in the insertion space to fix the side frames 350 and 360.

The second rib 1346 may be disposed in front of the front wall 342. The second rib 1346 may be disposed to be spaced a predetermined distance forward from the front wall 342. The second rib 1346 protrudes upward from the base 341.

When the side frames 350 and 360 are coupled to the lower frame 340, the side frames 350 and 360 may be disposed between the second rib 1346 and the front wall 342. In detail, the front surface portion 354 may be disposed and fixed between the second rib 1346 and the front wall 342. That is, the second rib 1346 may be disposed in front of a portion of the front surface portion 354 so that the side frames 350 and 360 is fixed.

The lower frame 340 may further include a frame coupling portion 347 to be coupled to the door liner 200. The frame coupling portion 347 may be disposed between the front wall 342 and the rear wall 344. The frame coupling portion 347 may be spaced apart from the front wall 342. Thus, a portion of the insulator 400 may be disposed between the front wall 342 and the frame coupling portion 347.

The frame coupling portion 347 may be provided in a shape protruding upward from the base 341. The door liner 200 and the lower frame 340 may be coupled to each other by a coupling member. The frame coupling portion 347 may include a first coupling hole 347*a* through which the coupling member passes.

The lower frame 340 may further include a handle portion 349 that provides a space for user's grip.

In summary with respect to the first fixing mechanism, when the side frames 350 and 360 are coupled to the lower frame 340, the rear extension portion 356 may be inserted into the frame fixing portion 1344*c*, and thus, the side frames 350 and 360 may be fixed to the lower frame 340.

In addition, the first frame hook 1344*d* may be inserted to pass through the first hook hole 355*a* of the rear surface portion 355 so that the side frames 350 and 360 are fixed to the lower frame 340.

The first rib 1345 may be disposed in the insertion space defined by the front surface portion 354 and the front rib 353 so that the side frames 350 and 360 are fixed to the lower frame 340.

The second rib 1346 may be disposed in front of the front surface portion 354 so that the side frames 350 and 360 are fixed to the lower frame 340.

Hereinafter, with respect to the second fixing mechanism of the first storage compartment door 21 according to this embodiment, the state in which the upper frame 310 is coupled to the side frames 350 and 360 will be described in more detail with reference to the drawings.

Figure 17:
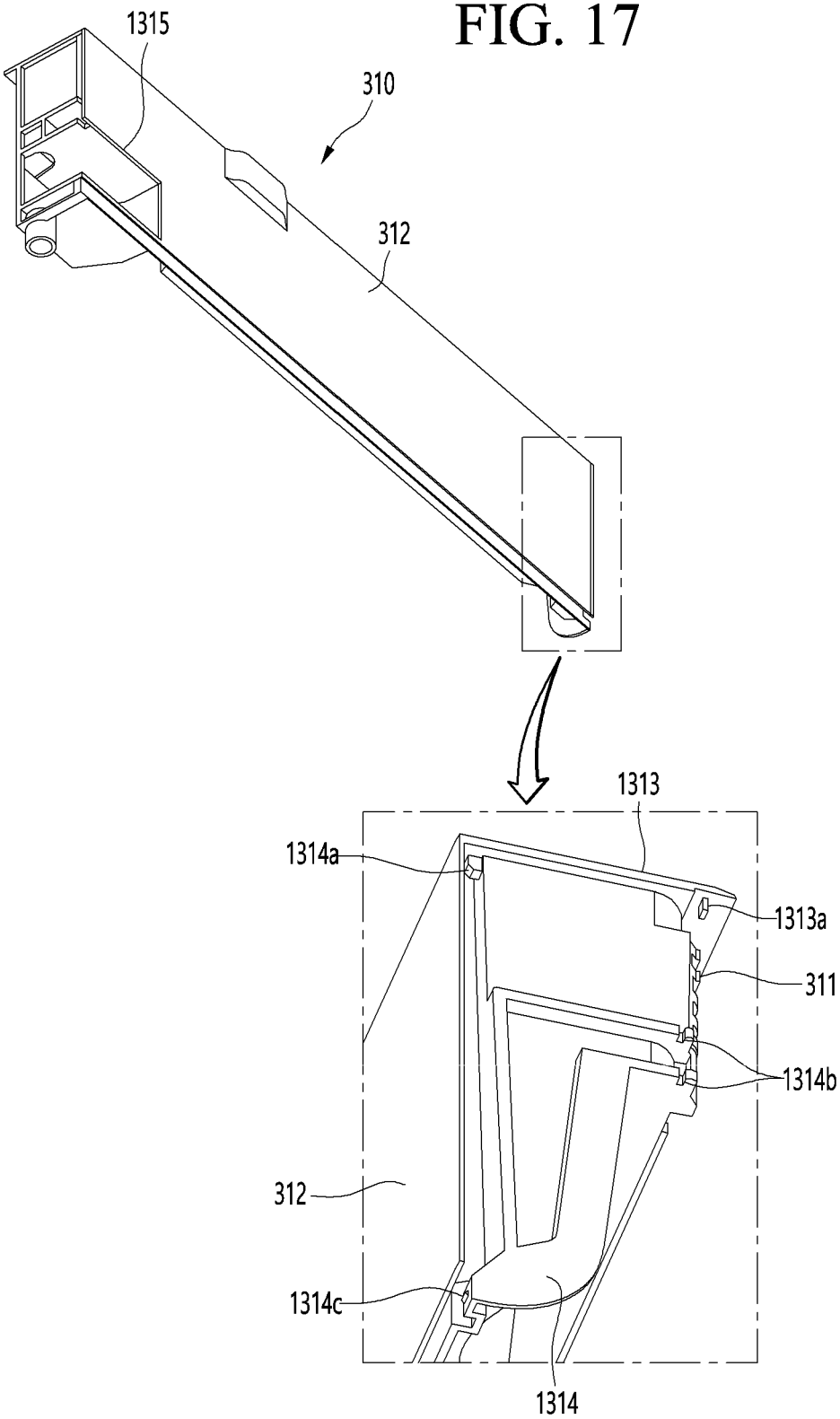
FIG. 17 is a perspective view of an upper frame according to another embodiment.
Figure 18:
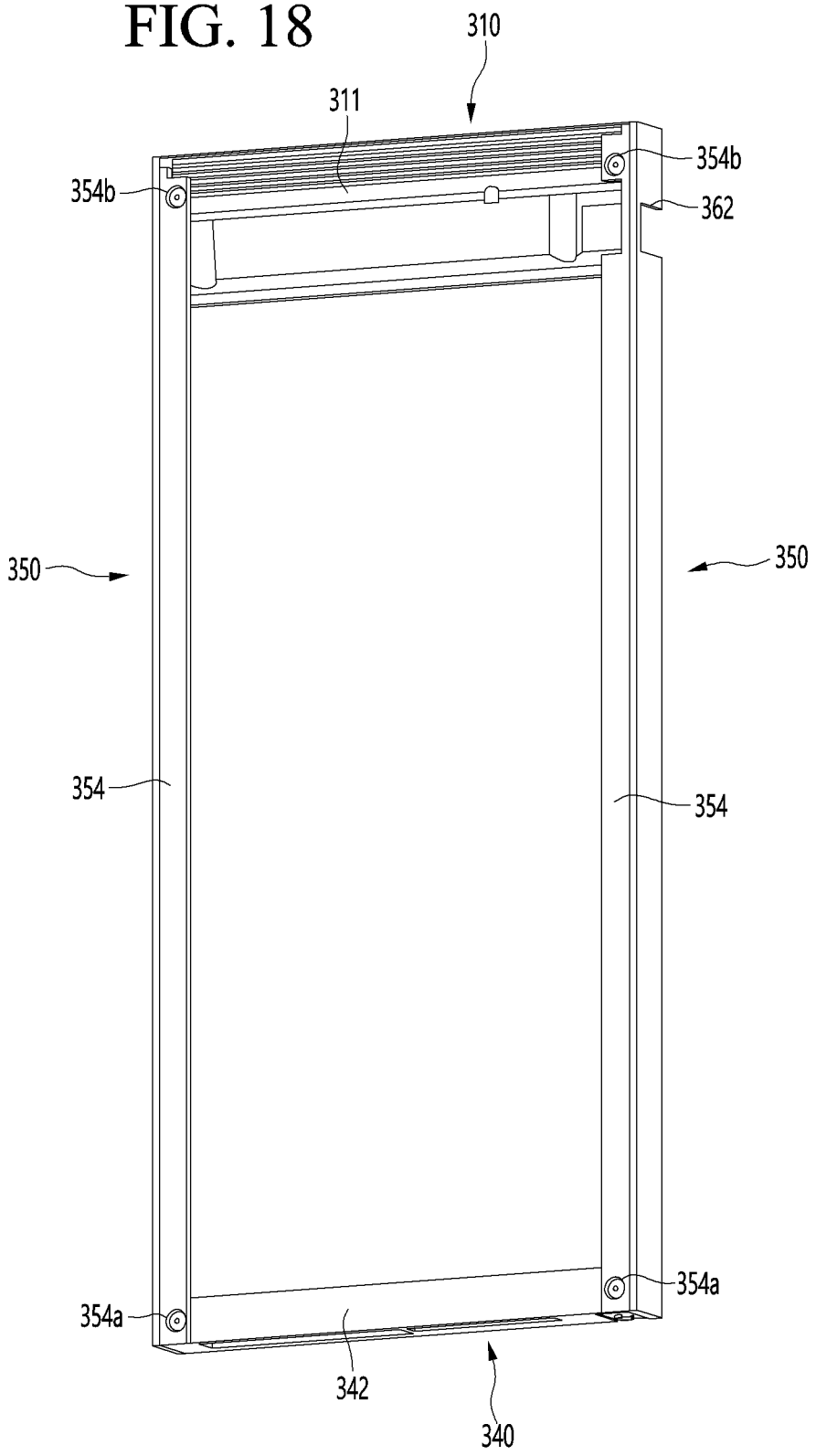
FIG. 18 is a perspective view illustrating a state in which the upper frame is coupled to the side frame according to an embodiment.
Figure 19:
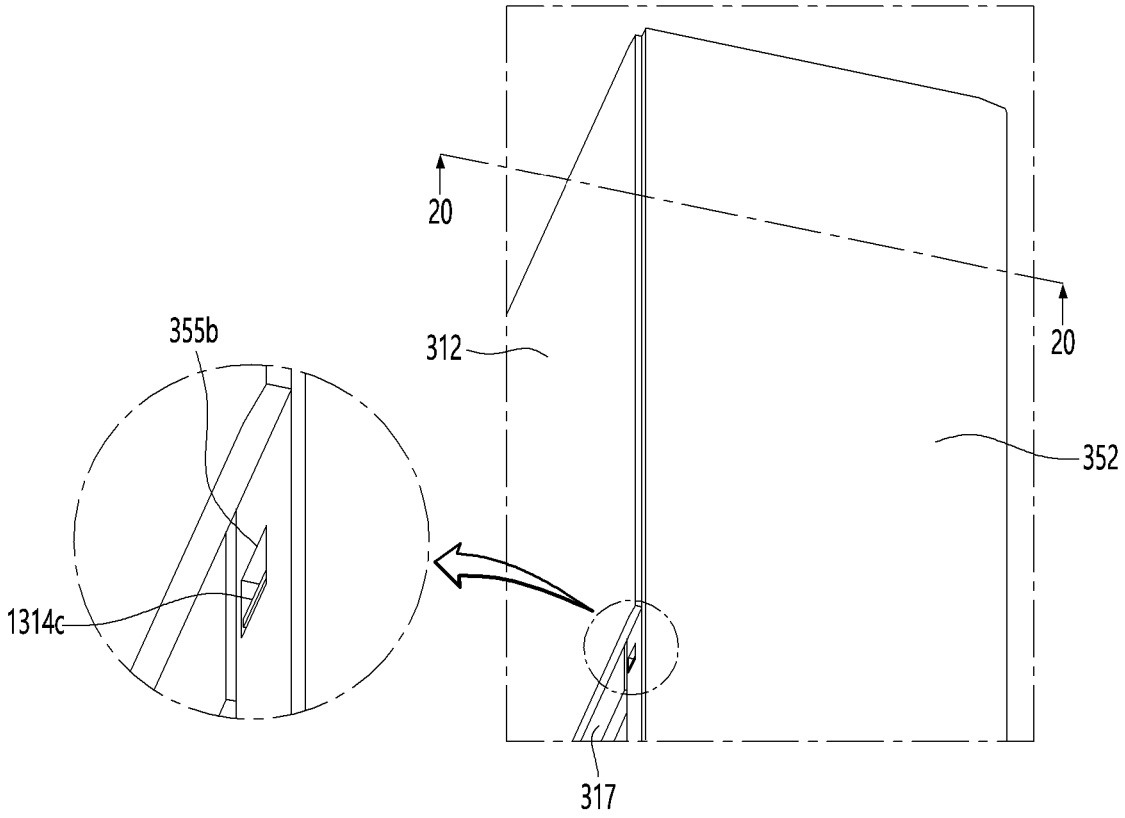
FIG. 19 is an enlarged view illustrating a side surface in FIG. 18.
Figure 20:
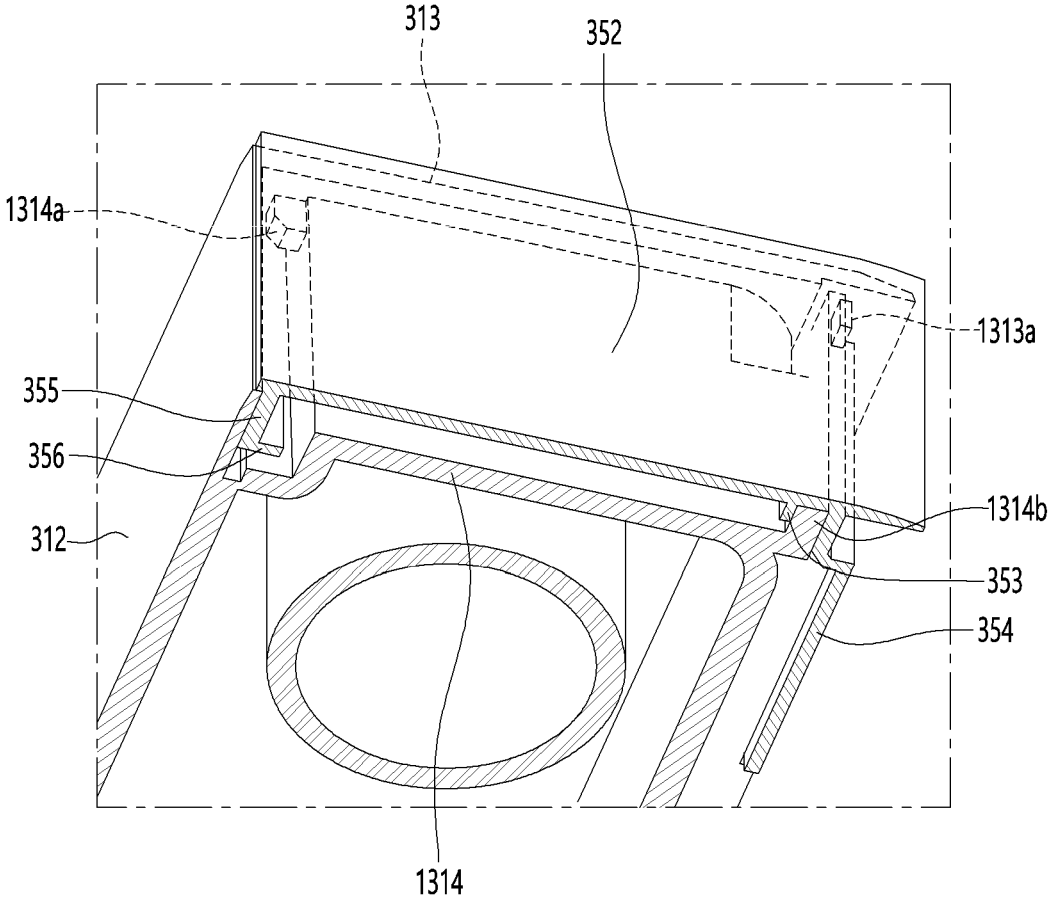
FIG. 20 is a cutaway view taken along line 20-20 of FIG. 19.

FIG. 17 is a perspective view of the upper frame according to another embodiment, FIG. 18 is a perspective view illustrating a state in which the upper frame is coupled to the side frame according to an embodiment, FIG. 19 is an enlarged view illustrating a side surface in FIG. 18, and FIG. 20 is a cutaway view taken along line 20-20 of FIG. 19.

Referring to FIGS. 17 to 20, in a state in which the side frames 350 and 360 are coupled to the lower frame 340, the upper frame 310 may be coupled to the side frames 350 and 360. In an embodiment, the upper frame 310 may be coupled to the side frames 350 and 360 while moving downward from the upper side.

The upper frame 310 may include some or all of an opened top surface portion 1313, the rear wall 312 bent from the top surface portion 1313 to extend downward, the front wall 311 extending downward at a position spaced a predetermined distance from a front end of the top surface portion 1313, and a side wall 1314 bent from the front wall 311 to extend toward the rear wall 312 and spaced a predetermined distance from the rear wall 312.

The top surface portion 1313 may be opened and be covered by the frame cover 320.

The rear wall 312 may be bent from the top surface portion 1313 to extend downward. A hinge accommodation portion 1315 having a recessed shape so that the hinge 26 is disposed may be provided in the rear wall 312.

The frame extension portion 317 may be provided at a lower end of the rear wall 312. The frame extension portion 317 may extend as much as a left and right width of the rear wall 312. The frame extension portion 317 may extend from the side wall 1314. Since the side wall 1314 is spaced a predetermined distance from the rear wall 312, the frame extension portion 317 is spaced a predetermined distance from the rear wall 312. In detail, the frame extension portion 317 is disposed to be spaced forward from the front side wall 312. Thus, the side frames 350 and 360 may be inserted into a spaced space between the rear wall 312 and the frame extension portion 317. In more detail, the rear surface portion 355 may be disposed between the rear wall 312 and the frame extension portion 317.

The side wall 1314 extends downward from the top surface portion 1313. The side wall 1314 extends downward at a position spaced a predetermined distance from a side end of the top surface part 1313.

The side wall 1314 is bent from the front wall 311 to extend toward the rear wall 312 and is spaced a predetermined distance from the rear wall 312. Thus, the side frames 350 and 360 may be inserted into the spaced space between the side wall 1314 and the rear wall 312. In more detail, the rear surface portion 355 may be disposed between the rear wall 312 and the side wall 314.

The side wall 1314 is spaced apart from the rear wall 312, and a rear surface of the side wall 1314 faces the rear wall 312. The side wall 1314 may include a third rid disposed on an upper portion of the rear surface to fix the side frames 350 and 360 and a second frame hook 1314*c* disposed on a lower portion of the rear surface to couple the side frames 350 and 360.

The third rib 1314*a* may be disposed on the upper portion of the rear surface of the side wall 1314 to protrude backward from the rear surface of the side wall 1314. Thus, the rear surface portion 355 disposed between the side wall 1314 and the rear wall 312 may be fixed by the third rib 1314*a*. In more detail, the third rib 1314*a* may be disposed in front of the rear surface portion 355 to fix the rear surface portion 355.

When the rear surface portion 355 is disposed between the side wall 1314 and the rear wall 312, the rear extension portion 356 may be disposed inside the third rib 1314*a*.

The second frame hook 1314*c* may be disposed on the upper portion of the rear surface of the side wall 1314 to protrude backward from the rear surface of the side wall 1314. A second hook hole 355*b* that is opened at a position corresponding to the position of the second frame hook 1314*c* may be defined in each of the side frames 350 and 360. In detail, the opened second hook hole 355*b* may be defined at a position corresponding to the position of the second frame hook 1314*c* of the rear surface portion 355. Thus, the second frame hook 1314*c* may be inserted to pass through the second hook hole 355*b* to fix the upper frame 310 to the side frames 350 and 360.

In an embodiment, the second frame hook 1314*c* may be inclined to protrude outward as it goes upward. Thus, the upper frame 310 may be easily coupled to the side frames 350 and 360 downward from the upper side.

The side wall 1314 may further include a fourth rib 1314*b* disposed at a front end of the side surface to fix the side frames 350 and 360. The fourth rib 1314*b* may protrude outward from the front end of the side surface of the side wall 1314.

A plurality of the fourth ribs 1314*b* may be provided. For example, as illustrated in the drawings, a plurality of fourth ribs 1314*b* may be provided to be spaced apart from each other in the vertical direction.

The fourth rib 1314*b* may be disposed in the insertion space defined by the front surface portion 354 and the front rib 353 in a state in which the upper frame 310 and the side frames 350 and 360 are coupled to each other. For this, the fourth rib 1314*b* may be disposed at a position corresponding to the insertion space. Thus, when the side frames 350 and 360 are coupled to the lower frame 340, the first rib 1345 may be disposed in the insertion space to fix the side frames 350 and 360.

The front wall 311 extends downward from the top surface portion 1313. The front wall 311 extends downward at a position spaced a predetermined distance from a front end of the top surface portion 1313.

In the state in which the upper frame 310 is coupled to the side frames 350 and 360, the front surface portion 354 is in contact with the front wall 311. In detail, the front surface portion 354 is in contact with the front wall 311 in front of the front wall 311.

The top surface portion 1313 includes a fifth rib 1313*a* protruding downward from the top surface portion 1313 in front of the front wall 311. The fifth rib 1313*a* is spaced a predetermined distance from the front wall 311. In detail, the fifth rib 1313*a* is disposed in front of the front surface portion 354 and spaced a predetermined distance from the front wall 311. Thus, the front surface portion 354 may be disposed between the front wall 311 and the fifth rib 1313*a* and be fixed by the fifth rib 1313*a*.

Thus, in summary with respect to the second fixing mechanism, when the upper frame 310 is coupled to the side frames 350 and 360, the third rib 1314*a* may be disposed in front of the rear surface portion 355, and thus, the rear surface portion 355 may be fixed, and the upper frame 310 may be fixed to the side frames 350 and 360.

In addition, the second frame hook 1314*c* may be inserted to pass through the second hook hole 355*b* of the rear surface portion 355 so that the upper frame 310 is fixed to the side frames 350 and 360.

The fourth rib 1314*b* may be disposed in the insertion space defined by the front surface portion 354 and the front rib 353 so that the upper frame 310 is fixed to the side frames 350 and 360.

The fifth rib 1313*a* may be disposed in front of the front surface portion 354 so that the upper frame 310 is fixed to the side frames 350 and 360.

The lower frame 310, the side frames 350 and 360, and the upper frame 310 may be coupled to provide or assemble the door frame 300 having the form of a rectangular frame having an opening. The panel assembly 100 may be fixed to the assembled door frame 300. Hereinafter, a state in which the panel assembly 100 is fixed to the assembled door frame 300 will be described with reference to the drawings.

Figure 21:
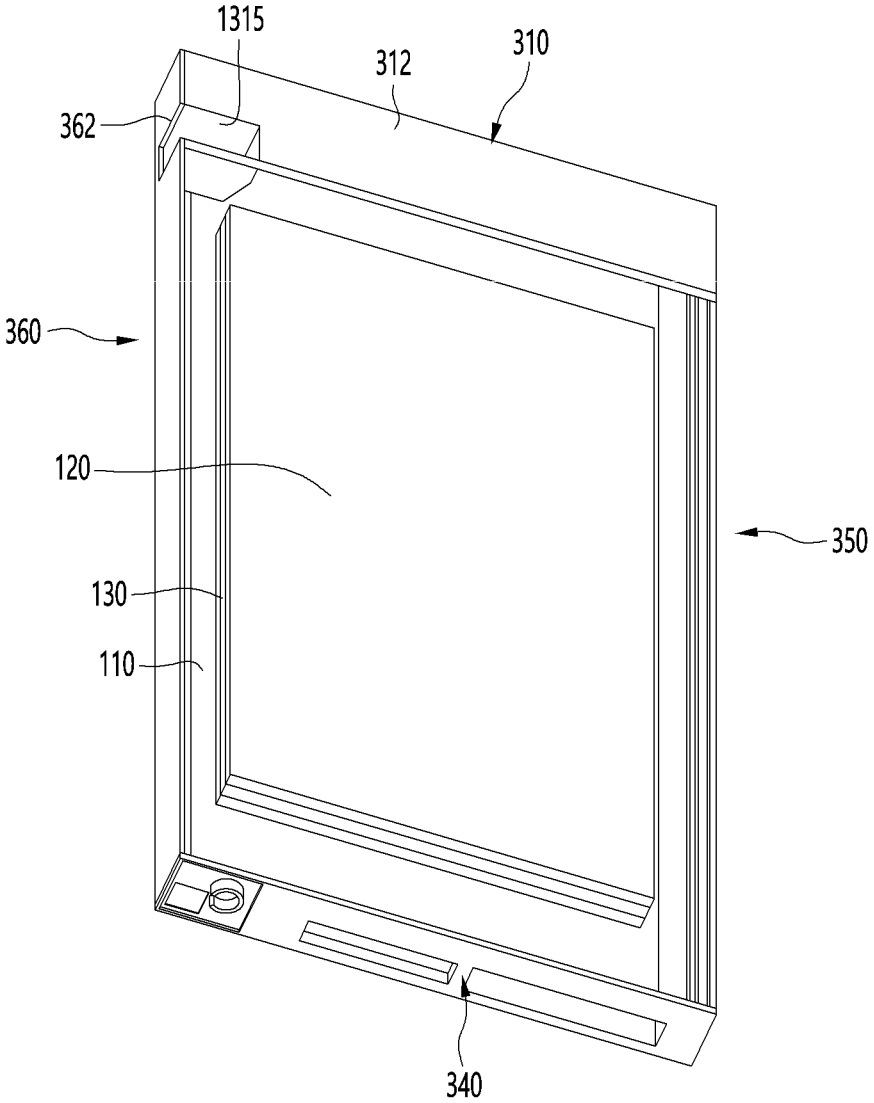
FIG. 21 is a perspective view illustrating a state in which a panel assembly is coupled to an assembled door frame according to another embodiment.
Figure 22:
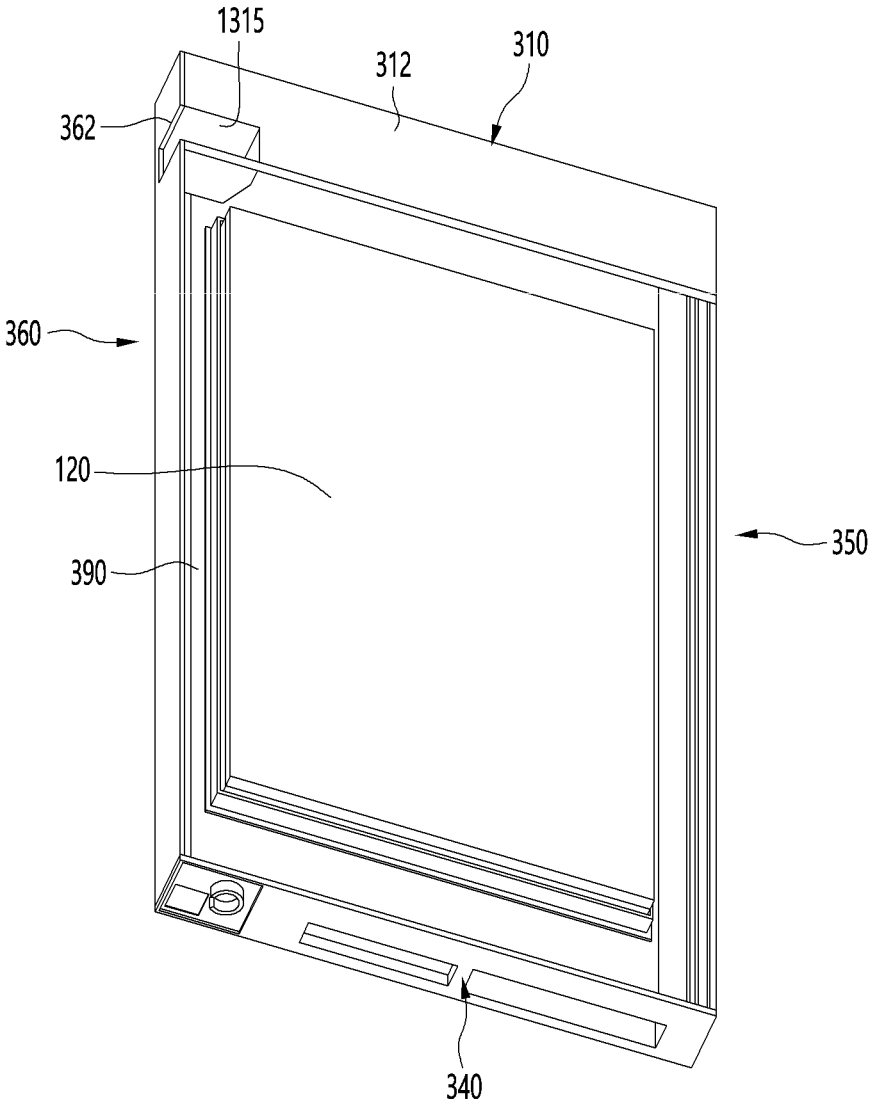
FIG. 22 is a perspective view illustrating a state in which a heater frame is coupled in FIG. 21.

FIG. 21 is a perspective view illustrating a state in which the panel assembly is coupled to the assembled door frame according to another embodiment, and FIG. 22 is a perspective view illustrating a state in which a heater frame is coupled in FIG. 21.

Referring to FIGS. 21 and 22, the panel assembly 100 may be fixed to the door frame 300.

In detail, the front panel 110 may be fixed to a front surface of the door frame 300 by the adhesion portion 330. The adhesion portion 330 may be, for example, an adhesive or a double-sided tape.

When the front panel 110 is fixed to the front of the door frame 300, the insulating panels 120 and 130 may be disposed in the opened space of the door frame 300.

The heater frame 390 may be attached to a rear surface of the front panel 110 by the adhesion portion. The heater frame 390 may be provided in the form of a rectangular frame, be disposed behind the front panel 110, and be disposed between the front panel 110 and the second insulating panel 130 to surround the spacer 140.

In the state in which the panel assembly 100 and the heater frame 390 are coupled to the door frame 300, the door liner 200 defining the insulating space 402 in which the insulator 400 is disposed may be coupled.

Hereinafter, a third fixing mechanism of the first storage compartment door 21 according to this embodiment will be described in more detail with reference to the drawings.

Figure 23:
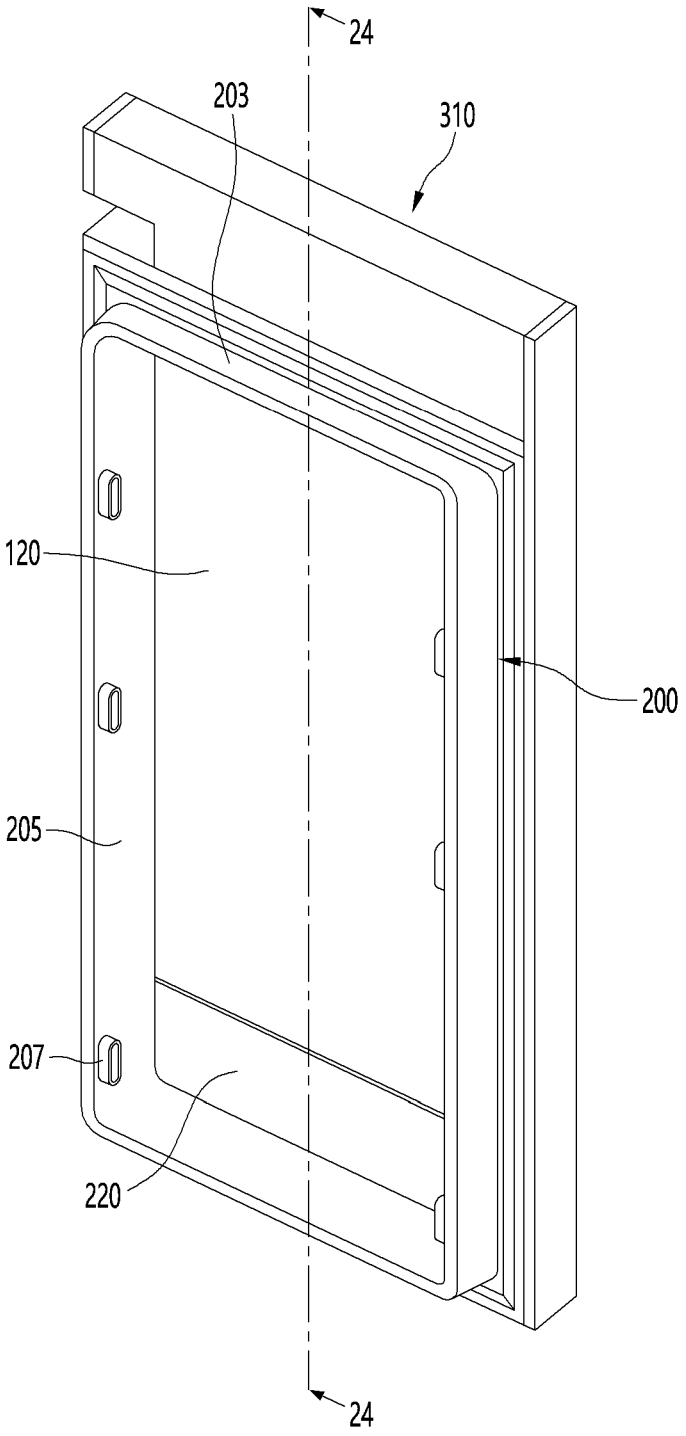
FIG. 23 is a perspective view illustrating a state in which a door liner is coupled in FIG. 22.
Figure 24:
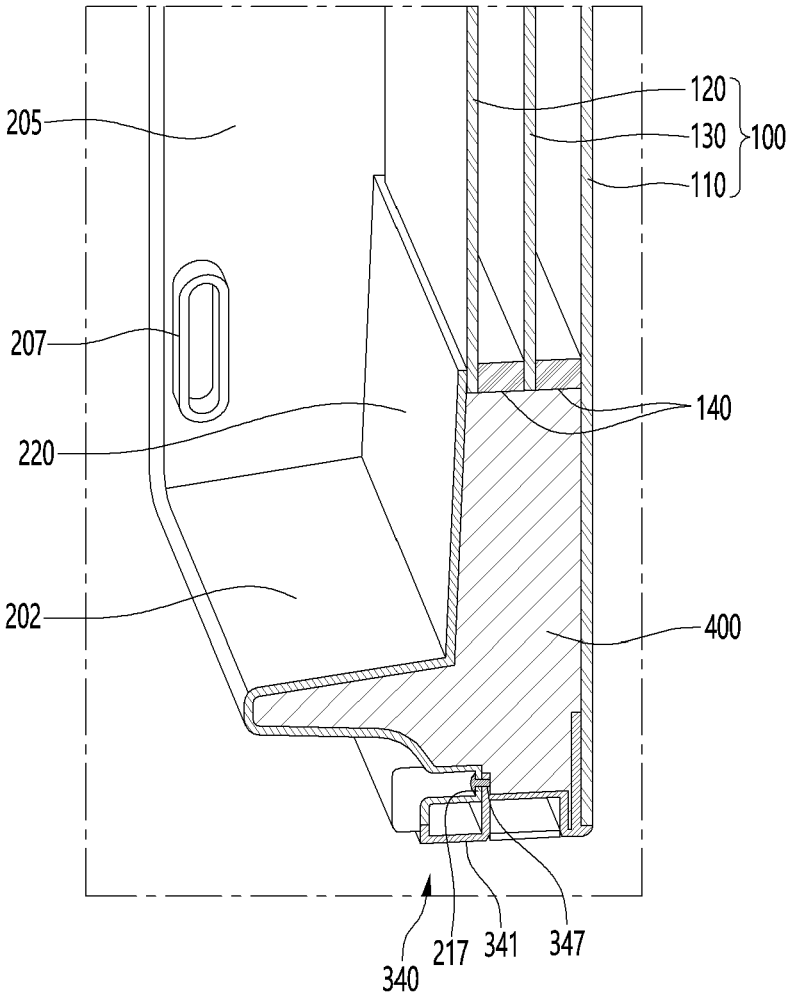
FIG. 24 is a cutaway cross-sectional view taken along line 24-24 of FIG. 23.
Figure 25:
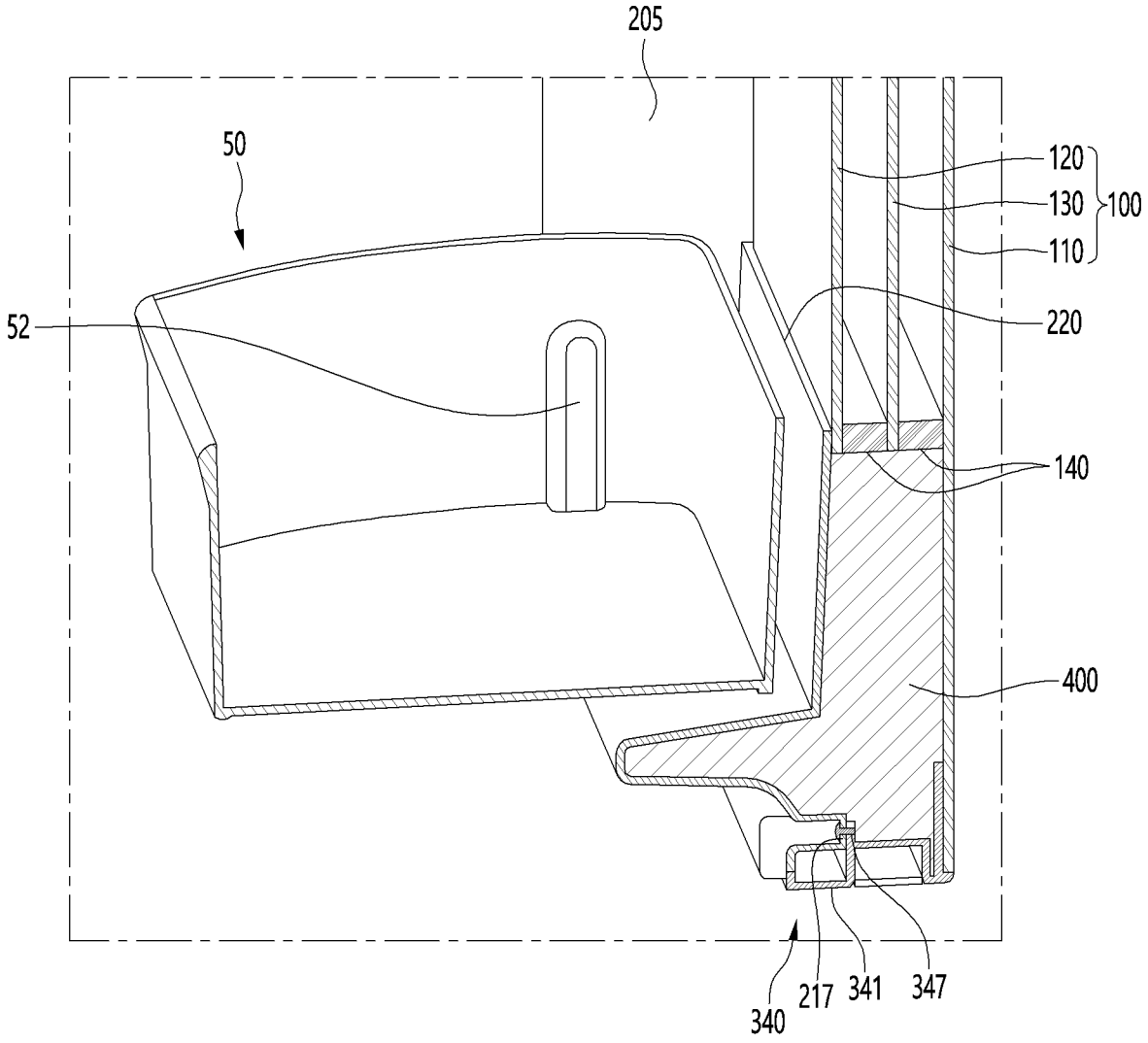
FIG. 25 is a perspective view illustrating a state in which a basket is coupled in FIG. 24.

FIG. 23 is a perspective view illustrating a state in which the door liner is coupled in FIG. 22, FIG. 24 is a cutaway cross-sectional view taken along line 24-24 of FIG. 23, and FIG. 25 is a perspective view illustrating a state in which the basket is coupled in FIG. 24.

Referring to FIGS. 23 to 25, the door liner 200 may include the inner body 202, the outer body 210, and the connection body 203 connecting the outer body 210 to the inner body 202.

The third fixing mechanism may include a rib 214 extending upward from a top surface of the outer body 210. Since the rib 214 has been described in detail with reference to FIG. 8, detailed descriptions thereof will be omitted.

Referring to FIGS. 12, 24 and 25, to couple the door liner 200 to the lower frame 340, the lower frame 340 may further include the frame coupling portion 347. Thus, a portion of the insulator 400 may be disposed between the front wall 341 and the frame coupling portion 347.

To couple the lower portion of the door liner 200 to the lower frame 340, the door liner 200 may include a liner coupling portion 217. The liner coupling portion 217 may protrude from the connection body 203. A second coupling hole 218 through which a coupling member passes may be defined in the liner coupling portion 217.

To couple the lower portion of the door liner 200 to the lower frame 340, the liner coupling portion 217 of the door liner 200 is in contact with the frame coupling portion 347 of the lower frame 340.

Then, the second coupling hole 218 of the liner coupling portion 217 and the first coupling hole 347*a* of the frame coupling portion 347 are aligned with each other. Also, the liner contact portion 212 of the door liner 200 is in contact with the rear surface of the rear wall 344 of the lower frame 340.

In this state, the coupling member is coupled to the liner coupling portion 217 and the frame coupling portion 347.

Then, the door liner 200 may be fixed to the lower frame 340, and even if the load is applied to the door liner 200, the door liner 200 may be prevented from being separated from the lower frame 340.

The door liner 200 may further include a liner extension portion 220 bent from a bottom surface of the inner body 202 to extend upward. The liner extension portion 220 may extend upward to be in contact with the panel assembly 100. In detail, the liner extension portion 220 may extend upward to be in contact with a rear surface of the insulating panel 120.

The shape of the door may not be deformed even if a foaming liquid is foamed in the insulating space 402 defined by the door liner 200 through the liner extension portion 220. In detail, the foaming liquid is injected through an opening (not shown) defined in the door liner 200, and the shape of the door may be deformed by foaming force. In this embodiment, the deformation may be prevented from occurring through the liner extension portion 220 extending upward from the inner body 202 and disposed to be in contact with the insulating panel 120.

In addition, the foaming liquid may be prevented from leaking to the outside through the liner extension portion 220.

In an embodiment, an upper end of the liner extension portion 220 may extend to be disposed lower than an upper end of the basket 50 coupled to the lowermost coupling protrusion 207. Therefore, when the basket 50 and the foods contained in the basket 50 are visible from the outside, the liner extension portion 220 may not be visible to provide the beautiful outer appearance.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator comprising:

a cabinet defining a storage space; and a door configured to open and close the storage space, wherein the door comprises:

a panel assembly configured to show the storage space therethrough and including a front panel, an insulating panel, and a spacer, a door frame connected to the panel assembly and including an upper frame, a lower frame, and side frames, and a door liner defining an opening and connected to the door frame and the insulating panel, wherein the door liner comprises:

an outer body, a connection body extending from the outer body, an inner body extending from the connection body and having side surfaces and a bottom surface, a plurality of coupling protrusions provided at the side surfaces of the inner body, an insulator received at an insulating space defined by the door frame, the panel assembly, and the door liner, a basket providing a plurality of protrusion grooves at side surfaces, the plurality of protrusion grooves being detachably coupled to the plurality of coupling protrusions of the inner body, a first liner extension portion extending upward from a bottom surface of the inner body toward the insulation panel, a first coupling member coupled to the upper frame and provided at an upper portion of the outer body, and a second coupling member coupled to the lower frame and provided at a lower portion of the outer body, and wherein the first liner extension portion contacts the insulation panel.

2. The refrigerator of claim 1, wherein the plurality of coupling protrusions are disposed below a top surface of the first liner extension portion, or wherein the top surface of the first liner extension portion is disposed below a top surface of the basket.

3. The refrigerator of claim 1, wherein the basket and the first liner extension portion are configured to, based on the basket being coupled to the inner body, define a gap therebetween.

4. The refrigerator of claim 1, wherein the front panel comprises (i) a first portion configured to transmit light and (ii) a second portion that is disposed at an outside of the first portion and configured to restrict transmission of light, and wherein a portion of the basket faces the first portion of the front panel.

5. The refrigerator of claim 1, wherein the upper frame defines a space covered by a frame cover.

6. The refrigerator of claim 1, wherein the door further comprises a heater frame configured to receive a heater and surrounding the spacer.

7. The refrigerator of claim 6, wherein the heater frame has a rectangular shape and is attached to a rear surface of the front panel.

8. The refrigerator of claim 1, wherein the first coupling member comprises:

a second liner extension portion extending from the outer body, a rib spaced apart from the first liner extension portion, and a frame extension portion disposed between the rib and the first liner extension portion.

9. The refrigerator of claim 8, wherein the outer body includes a gasket coupling portion that is recessed to receive a gasket, and wherein the second liner extension portion and the rib are extended from the gasket coupling portion.

10. The refrigerator of claim 8, wherein the rib is provided in plurality to be horizontally spaced apart from each other on the outer body, and wherein the rib includes a first part extending from the outer body and a second part that extends from the first part and that is inclined in a direction away from the second liner extension portion.

11. The refrigerator of claim 1, wherein the first coupling member includes:

a liner coupling portion extending from the connecting body, a frame coupling portion coupled to the liner coupling portion, and a coupling member that couples the liner coupling portion to the frame coupling portion.

12. The refrigerator of claim 11, wherein the door liner provides a gasket coupling portion that is recessed to receive a gasket, wherein the liner coupling portion protrudes from an outer surface of the gasket coupling portion, and wherein the gasket is configured to, based on the coupling member being coupled to the liner coupling portion and the frame coupling portion, couple to the gasket coupling portion to cover the coupling member.

13. The refrigerator of claim 1, wherein the second coupling member includes:

a liner coupling portion extending from the connecting body, a frame coupling portion coupled to the liner coupling portion, and a coupling member that couples the liner coupling portion to the frame coupling portion.

14. The refrigerator of claim 13, wherein the door liner comprises a gasket coupling portion that is recessed to receive a gasket, wherein the liner coupling portion protrudes from an outer surface of the gasket coupling portion, and wherein the gasket is configured to, based on the coupling member being coupled to the liner coupling portion and the frame coupling portion, couple to the gasket coupling portion to cover the coupling member.

15. The refrigerator of claim 1, wherein the second coupling member comprises:

a third liner extension portion extending from the outer body in a direction crossing the outer body, a rib disposed to be spaced apart from the third liner extension portion, and a frame extension portion disposed between the rib and the third liner extension portion.

16. The refrigerator of claim 15, wherein the rib is provided in plurality to be horizontally spaced apart from each other on the outer body.

17. The refrigerator of claim 15, wherein the rib includes a first part extending from the outer body and a second part that extends from the first part and that is inclined in a direction away from the third liner extension portion.

18. A refrigerator comprising:

a cabinet defining a storage space; and a door configured to open and close the storage space, wherein the door comprises:

a panel assembly configured to show the storage space therethrough and including a front panel, an insulating panel, and a spacer, a door frame connected to the panel assembly and including an upper frame, a lower frame, and side frames, a door liner defining an opening and connected to the door frame and the insulating panel, wherein the door liner comprises:

an outer body, a connection body extending from the outer body, an inner body extending from the connection body and having side surfaces and a bottom surface, a plurality of coupling protrusions provided at the side surfaces of the inner body, an insulator received at an insulating space defined by the door frame, the panel assembly, and the door liner, the insulator in the insulating space being in contact with the panel assembly, a basket providing a plurality of protrusion grooves at side surfaces, the plurality of protrusion grooves being detachably coupled to the plurality of coupling protrusions of the inner body, a first liner extension portion extending upward from a bottom surface of the inner body toward the insulation panel, a first coupling member coupled to the upper frame and provided at an upper portion of the outer body, and a second coupling member coupled to the lower frame and provided at a lower portion of the outer body, and wherein the upper frame includes a plurality of protrusions contacting the front panel.

19. The refrigerator of claim 18, wherein the first coupling member comprises:

a second liner extension portion extending from the outer body, a rib spaced apart from the first liner extension portion, and a frame extension portion disposed between the rib and the first liner extension portion, or wherein the second coupling member includes:

a liner coupling portion extending from the connecting body, a frame coupling portion coupled to the liner coupling portion, and a coupling member that couples the liner coupling portion to the frame coupling portion.

20. The refrigerator of claim 18, wherein the first coupling member includes:

a liner coupling portion extending from the connecting body, a frame coupling portion coupled to the liner coupling portion, and a coupling member that couples the liner coupling portion to the frame coupling portion, or wherein the second coupling member comprises:

a third liner extension portion extending from the outer body in a direction crossing the outer body, a rib disposed to be spaced apart from the third liner extension portion, and a frame extension portion disposed between the rib and the third liner extension portion.

* * * * *